US009273860B2

(12) United States Patent
Pratt et al.

(10) Patent No.: US 9,273,860 B2
(45) Date of Patent: Mar. 1, 2016

(54) SENSOR MODULE FOR A LIGHTING FIXTURE

(71) Applicant: Cree, Inc., Durham, NC (US)

(72) Inventors: Spencer Scott Pratt, Cary, NC (US); Shawn Leroux Heeter, Morrisville, NC (US)

(73) Assignee: Cree, Inc., Durham, NC (US)

( * ) Notice: Subject to any disclaimer, the term of this patent is extended or adjusted under 35 U.S.C. 154(b) by 134 days.

(21) Appl. No.: 14/084,183

(22) Filed: Nov. 19, 2013

(65) Prior Publication Data

US 2015/0138784 A1 May 21, 2015

(51) Int. Cl.
*F21V 23/04* (2006.01)
*F21V 29/76* (2015.01)
*F21S 8/02* (2006.01)

(52) U.S. Cl.
CPC ..... *F21V 23/0442* (2013.01); *F21V 23/0464* (2013.01); *F21V 23/0471* (2013.01); *F21V 29/76* (2015.01); *F21S 8/026* (2013.01)

(58) Field of Classification Search
CPC . F21V 23/0442; F21V 29/76; F21V 23/0464; F21V 23/0471; F21S 8/026
See application file for complete search history.

(56) References Cited

U.S. PATENT DOCUMENTS 5,126,510 A 6/1992 Bauer et al.
5,869,786 A 2/1999 Jaakkola et al.
6,466,312 B1 10/2002 Li
7,411,489 B1 8/2008 Elwell et al.
7,490,960 B1 2/2009 Fiorino et al.
D587,613 S 3/2009 Williams et al.
D597,430 S 8/2009 Sloan et al.
D621,996 S 8/2010 Redfern et al.
D623,344 S 9/2010 Tsai
7,800,049 B2 9/2010 Bandringa et al.
7,800,498 B2 9/2010 Leonard et al.
D649,688 S 11/2011 Trzesniowski
D668,164 S 10/2012 Cowles et al.
8,348,492 B2 1/2013 Mier-Langner et al.
8,461,510 B2 6/2013 Williams et al.
8,530,840 B2 9/2013 Carberry et al.
8,616,720 B2 12/2013 Carney et al.
D698,076 S 1/2014 Klus
8,651,711 B2 2/2014 Rudisill et al.
D706,152 S 6/2014 Ni et al.
8,764,220 B2 7/2014 Chan et al.
2004/0252514 A1 12/2004 Okabe et al.
2007/0229297 A1* 10/2007 Leonard et al. ..... 340/693.5
2007/0273290 A1* 11/2007 Ashdown et al. ..... 315/113

(Continued)

OTHER PUBLICATIONS

Notice of Allowance for U.S. Appl. No. 29/480,523, mailed Jul. 31, 2015, 8 pages.

(Continued)

*Primary Examiner* — Mary Ellen Bowman
(74) *Attorney, Agent, or Firm* — Withrow & Terranova, P.L.L.C.

(57) ABSTRACT

A sensor module is integrated into a lighting fixture. The sensor module includes one or more environmental sensors and can be readily installed in or removed from the lighting fixture. In one embodiment, a heatsink of the lighting fixture is configured to receive the sensor module. Readings from the environmental sensors may be passed to control electronics associated with the lighting fixture and used to control the light output of the lighting fixture. The readings may also be passed on to other lighting fixtures, which may also use the readings to control their light output.

31 Claims, 18 Drawing Sheets

(56) References Cited

U.S. PATENT DOCUMENTS

| | | | | |
|---|---|---|---|---|
| 2008/0278079 | A1 | 11/2008 | Chen et al. | |
| 2009/0046457 | A1* | 2/2009 | Everhart | 362/235 |
| 2009/0279298 | A1 | 11/2009 | Mier-Langner et al. | |
| 2010/0013619 | A1 | 1/2010 | Zimmer | |
| 2010/0052894 | A1 | 3/2010 | Steiner et al. | |
| 2010/0277917 | A1 | 11/2010 | Shan | |
| 2010/0294915 | A1* | 11/2010 | Williams et al. | 250/206.1 |
| 2012/0169507 | A1 | 7/2012 | Dyer et al. | |
| 2013/0033872 | A1 | 2/2013 | Randolph et al. | |
| 2013/0200805 | A1 | 8/2013 | Scapa et al. | |
| 2013/0207528 | A1 | 8/2013 | Carberry et al. | |
| 2013/0341510 | A1 | 12/2013 | Aurongzeb et al. | |
| 2014/0001362 | A1 | 1/2014 | Huang | |
| 2014/0001952 | A1 | 1/2014 | Harris et al. | |
| 2014/0001962 | A1 | 1/2014 | Harris | |
| 2014/0043733 | A1 | 2/2014 | Huang | |
| 2014/0061480 | A1 | 3/2014 | Huang | |
| 2014/0070710 | A1 | 3/2014 | Harris | |
| 2014/0239821 | A1 | 8/2014 | Leonard | |
| 2014/0293646 | A1 | 10/2014 | Iwazaki et al. | |
| 2014/0313711 | A1 | 10/2014 | Hwu et al. | |
| 2014/0379305 | A1 | 12/2014 | Kumar | |
| 2015/0009664 | A1 | 1/2015 | Liang | |

OTHER PUBLICATIONS

Restriction Requirement for U.S. Appl. No. 29/473,157, mailed Mar. 16, 2015, 5 pages.

Notice of Allowance for U.S. Appl. No. 29/473,157, mailed Jun. 4, 2015, 7 pages.

Notice of Allowance and Examiner-Initiated Interview Summary for U.S. Appl. No. 14/278,443, mailed Nov. 3, 2015, 12 pages.

Corrected Notice of Allowance for U.S. Appl. No. 29/480,523, mailed Dec. 4, 2015, 4 pages.

* cited by examiner

SENSOR MODULE FOR A LIGHTING FIXTURE

CROSS-REFERENCE TO RELATED APPLICATIONS

This application is related to concurrently filed U.S. design patent application Ser. No. 29/473,157 entitled SENSOR MODULE, the disclosure of which is incorporated herein by reference in its entirety. This application is also related to U.S. patent application Ser. No. 13/868,021, filed Apr. 22, 2013, the disclosure of which is incorporated herein by reference in its entirety.

FIELD OF THE DISCLOSURE

The present disclosure relates to lighting fixtures, and in particular to a sensor module for lighting fixtures that are employed in a lighting network.

BACKGROUND

In recent years, a movement has gained traction to replace incandescent light bulbs with lighting fixtures that employ more efficient lighting technologies as well as to replace relatively efficient fluorescent lighting fixtures with lighting technologies that produce a more pleasing, natural light. One such technology that shows tremendous promise employs light emitting diodes (LEDs). Compared with incandescent bulbs, LED-based light fixtures are much more efficient at converting electrical energy into light, are longer lasting, and are also capable of producing light that is very natural. Compared with fluorescent lighting, LED-based fixtures are also very efficient, but are capable of producing light that is much more natural and more capable of accurately rendering colors. As a result, lighting fixtures that employ LED technologies are replacing incandescent and fluorescent bulbs in residential, commercial, and industrial applications.

Unlike incandescent bulbs that operate by subjecting a filament to a desired current, LED-based lighting fixtures require electronics to drive one or more LEDs. The electronics generally include a power supply and a special control circuitry to provide uniquely configured signals that are required to drive the one or more LEDs in a desired fashion. The presence of the control circuitry adds a potentially significant level of intelligence to the lighting fixtures that can be leveraged to employ various types of lighting control. Such lighting control may be based on various environmental conditions, such as ambient light, occupancy, temperature, and the like.

With the added intelligence and control based on environmental conditions, there is a need to integrate environmental sensors in an effective and efficient manner in these lighting fixtures.

SUMMARY

The present disclosure relates to the integration of a sensor module into a lighting fixture. The sensor module includes one or more environmental sensors and can be readily installed in or removed from the lighting fixture. In one embodiment, a heatsink of the lighting fixture is configured to receive the sensor module. Readings from the environmental sensors may be passed to control electronics associated with the lighting fixture and used to control the light output of the lighting fixture. The readings may also be passed on to other lighting fixtures, which may also use the readings to control their light output.

In one embodiment, the lighting fixture generally includes a light source, a main structure, a heatsink, and a light source provided within the main structure such that light emitted by the light source is directed out of the housing toward an illuminated area. The heatsink may be thermally coupled to the light source and have an exposed portion that is at least partially exposed to the illuminated area. The sensor module includes at least one environmental sensor and is integrated into the exposed portion of the heatsink, such that the environmental sensors are also exposed to the illuminated area. The environmental sensor may be directly or indirectly exposed to the illuminated area via a conduit. For example, an ambient light sensor may be provided within the sensor module, and the conduit may be a light pipe that extends into the sensor module to direct ambient light from the illuminated area to the ambient light sensor. As another example, an occupancy sensor may be integrated into the sensor module such that the occupancy sensor is directly exposed to the illuminated area. The sensor module may contain multiple sensors, wherein the different sensors are used to detect the same or different environmental conditions.

Those skilled in the art will appreciate the scope of the disclosure and realize additional aspects thereof after reading the following detailed description in association with the accompanying drawings.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

Figure 1:
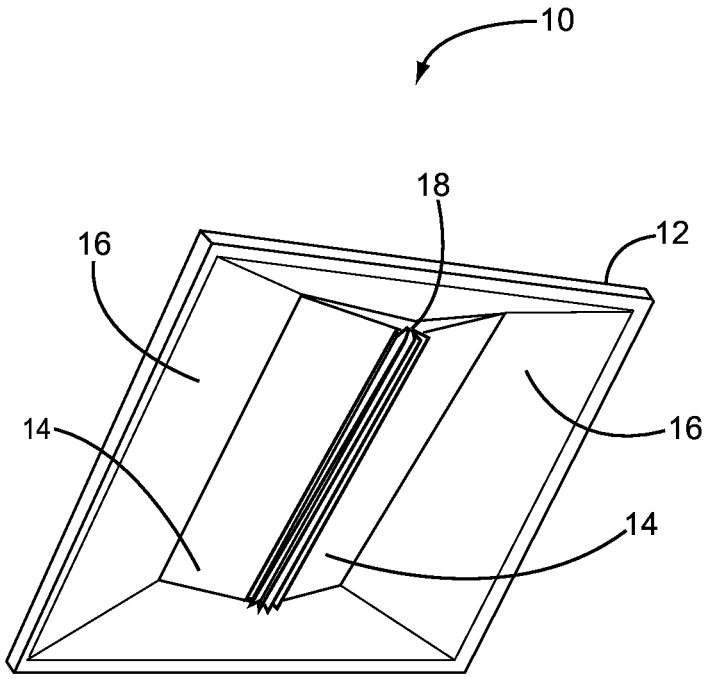
FIG. 1 is a perspective view of a troffer-based lighting fixture according to one embodiment of the disclosure.

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

It will be understood that relative terms such as "front," "forward," "rear," "below," "above," "upper," "lower," "horizontal," or "vertical" may be used herein to describe a relationship of one element, layer or region to another element, layer or region as illustrated in the figures. It will be understood that these terms are intended to encompass different orientations of the device in addition to the orientation depicted in the figures.

The present disclosure relates to the integration of a sensor module into a lighting fixture. The sensor module includes one or more environmental sensors and can be readily installed in or removed from the lighting fixture. In one embodiment, a heatsink of the lighting fixture is configured to receive the sensor module. Readings from the environmental sensors may be passed to control electronics associated with the lighting fixture and used to control the light output of the lighting fixture. The readings may also be passed on to other lighting fixtures, which may also use the readings to control their light output.

In one embodiment, the lighting fixture generally includes a light source, a main structure, a heatsink, and a light source provided within the main structure such that light emitted by the light source is directed out of the housing toward an illuminated area. The heatsink may be thermally coupled to the light source and have an exposed portion that is at least partially exposed to the illuminated area. The sensor module includes at least one environmental sensor and is integrated into the exposed portion of the heatsink, such that the environmental sensors are also exposed to the illuminated area. The environmental sensor may be directly or indirectly exposed to the illuminated area via a conduit. For example, an ambient light sensor may be provided within the sensor module, and the conduit may be a light pipe that extends into the sensor module to direct ambient light from the illuminated area to the ambient light sensor. As another example, an occupancy sensor may be integrated into the sensor module such that the occupancy sensor is directly exposed to the illuminated area. The sensor module may contain multiple sensors, wherein the different sensors are used to detect the same or different environmental conditions.

Prior to delving into the details of the present disclosure, an overview of an exemplary lighting fixture is provided. While the concepts of the present disclosure may be employed in any type of lighting system, the immediately following description describes these concepts in a troffer-type lighting fixture, such as the lighting fixture 10 illustrated in FIGS. 1-3. This particular lighting fixture is substantially similar to the CR and CS series of troffer-type lighting fixtures that are manufactured by Cree, Inc. of Durham, N.C.

While the disclosed lighting fixture 10 employs an indirect lighting configuration wherein light is initially emitted upward from a light source and then reflected downward, direct lighting configurations may also take advantage of the concepts of the present disclosure. In addition to troffer-type lighting fixtures, the concepts of the present disclosure may also be employed in recessed lighting configurations, wall mount lighting configurations, outdoor lighting configurations, and the like. Reference is made to co-pending and co-assigned U.S. patent application Ser. No. 13/589,899 filed Aug. 20, 2013, Ser. No. 13/649,531 filed Oct. 11, 2012, and Ser. No. 13/606,713 filed Sep. 7, 2012, now U.S. Pat. No. 8,829,800, the contents of which are incorporated herein by reference in their entireties. Further, the functionality and control techniques described below may be used to control different types of lighting fixtures, as well as different groups of the same or different types of lighting fixtures at the same time.

Figure 2:
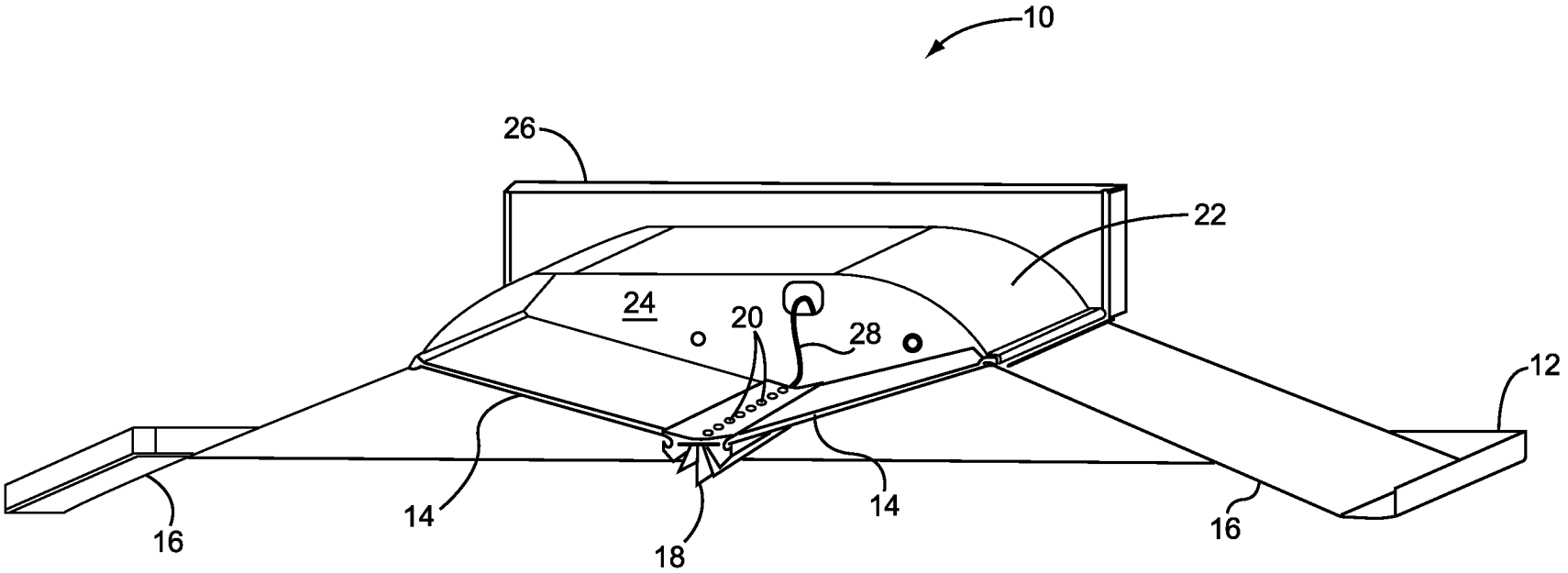
FIG. 2 is a cross section of the lighting fixture of FIG. 1.
Figure 3:
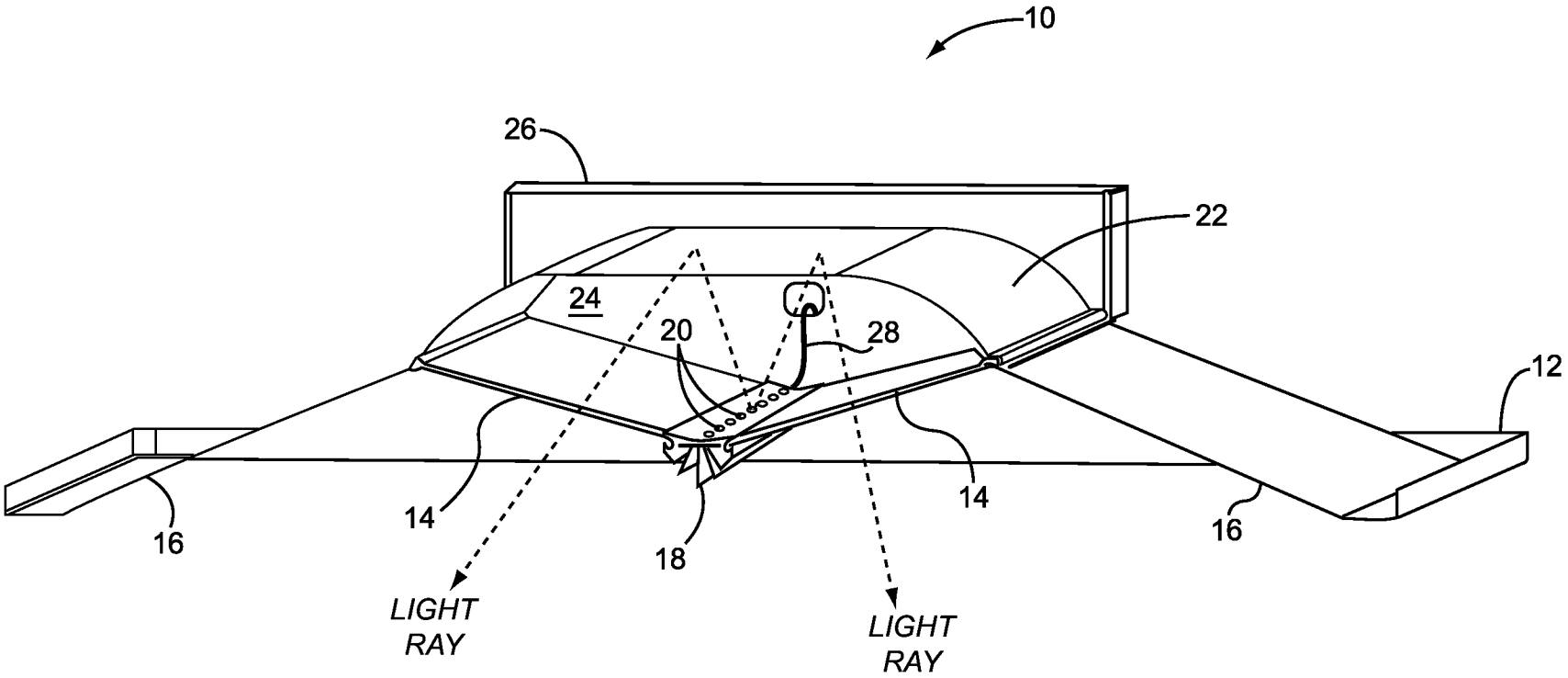
FIG. 3 is a cross section of the lighting fixture of FIG. 1 illustrating how light emanates from the LEDs of the lighting fixture and is reflected out through lenses of the lighting fixture.

In general, troffer-type lighting fixtures, such as the lighting fixture 10, are designed to mount in a ceiling. In most applications, the troffer-type lighting fixtures are mounted into a drop ceiling (not shown) of a commercial, educational, or governmental facility. As illustrated in FIGS. 1-3, the lighting fixture 10 includes a square or rectangular outer frame 12. In the central portion of the lighting fixture 10 are two rectangular lenses 14, which are generally transparent, translucent, or opaque. Reflectors 16 extend from the outer frame 12 to the outer edges of the lenses 14. The lenses 14 effectively extend between the innermost portions of the reflectors 16 to an elongated heatsink 18, which functions to join the two inside edges of the lenses 14.

Turning now to FIGS. 2 and 3 in particular, the back side of the heatsink 18 provides a mounting structure for an LED array 20, which includes one or more rows of individual LEDs mounted on an appropriate substrate. The LEDs are oriented to primarily emit light upwards toward a concave cover 22. The volume bounded by the cover 22, the lenses 14, and the back of the heatsink 18 provides a mixing chamber 24. As such, light will emanate upwards from the LEDs of the LED array 20 toward the cover 22 and will be reflected downward through the respective lenses 14, as illustrated in FIG. 3. Notably, not all light rays emitted from the LEDs will reflect directly off of the bottom of the cover 22 and back through a particular lens 14 with a single reflection. Many of the light rays will bounce around within the mixing chamber 24 and effectively mix with other light rays, such that a desirably uniform light is emitted through the respective lenses 14.

Those skilled in the art will recognize that the type of lenses 14, the type of LEDs, the shape of the cover 22, and any coating on the bottom side of the cover 22, among many other variables, will affect the quantity and quality of light emitted by the lighting fixture 10. As will be discussed in greater detail below, the LED array 20 may include LEDs of different colors, wherein the light emitted from the various LEDs mixes together to form a white light having a desired color temperature and quality based on the design parameters for the particular embodiment.

As is apparent from FIGS. 2 and 3, the elongated fins of the heatsink 18 may be visible from the bottom of the lighting fixture 10. Placing the LEDs of the LED array 20 in thermal contact along the upper side of the heatsink 18 allows any heat generated by the LEDs to be effectively transferred to the elongated fins on the bottom side of the heatsink 18 for dissipation within the room in which the lighting fixture 10 is mounted. Again, the particular configuration of the lighting fixture 10 illustrated in FIGS. 1-3 is merely one of the virtually limitless configurations for lighting fixtures 10 in which the concepts of the present disclosure are applicable.

Figure 4:
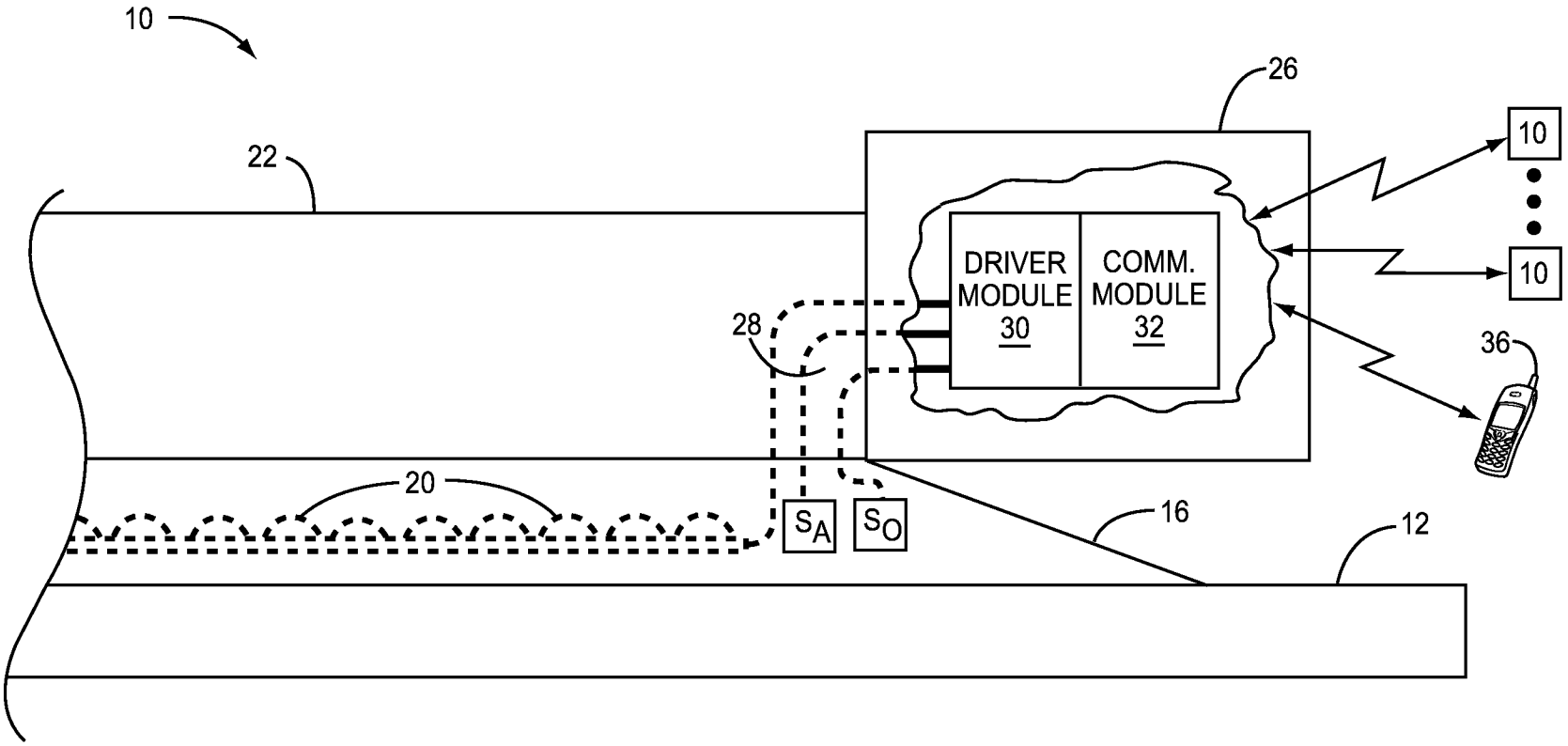
FIG. 4 illustrates a driver module and a communications module integrated within an electronics housing of the lighting fixture of FIG. 1.

With continued reference to FIGS. 2 and 3, an electronics housing 26 is shown mounted at one end of the lighting fixture 10, and is used to house all or a portion of the electronics used to power and control the LED array 20. These electronics are coupled to the LED array 20 through appropriate cabling 28. With reference to FIG. 4, the electronics provided in the electronics housing 26 may be divided into a driver module 30 and a communications module 32.

At a high level, the driver module 30 is coupled to the LED array 20 through the cabling 28 and directly drives the LEDs of the LED array 20 based on control information provided by the communications module 32. In one embodiment, the driver module 30 provides the primary intelligence for the lighting fixture 10 and is capable of driving the LEDs of the LED array 20 in a desired fashion. The driver module 30 may be provided on a single, integrated module or divided into two or more sub-modules depending the desires of the designer.

When the driver module provides the primary intelligence for the lighting fixture 10, the communications module 32 acts as an intelligent communication interface that facilitates communications between the driver module 30 and other lighting fixtures 10, a remote control system (not shown), or a portable handheld commissioning tool 36, which may also be configured to communicate with a remote control system in a wired or wireless fashion.

Alternatively, the driver module 30 may be primarily configured to drive the LEDs of the LED array 20 based on instructions from the communications module 32. In such an embodiment, the primary intelligence of the lighting fixture 10 is provided in the communications module 32, which effectively becomes an overall control module with wired or wireless communication capability, for the lighting fixture 10. The lighting fixture 10 may share sensor data, instructions, and any other data with other lighting fixtures 10 in the lighting network or with remote entities. In essence, the communications module 32 facilitates the sharing of intelligence and data among the lighting fixtures 10 and other entities.

In the embodiment of FIG. 4, the communications module 32 may be implemented on a separate printed circuit board (PCB) than the driver module 30. The respective PCBs of the driver module 30 and the communications module 32 may be configured to allow the connector of the communications module 32 to plug into the connector of the driver module 30, wherein the communications module 32 is mechanically mounted, or affixed, to the driver module 30 once the connector of the communications module 32 is plugged into the mating connector of the driver module 30.

In other embodiments, a cable may be used to connect the respective connectors of the driver module 30 and the communications module 32, other attachment mechanisms may be used to physically couple the communications module 32 to the driver module 30, or the driver module 30 and the communications module 32 may be separately affixed to the inside of the electronics housing 26. In such embodiments, the interior of the electronics housing 26 is sized appropriately to accommodate both the driver module 30 and the communications module 32. In many instances, the electronics housing 26 provides a plenum rated enclosure for both the driver module 30 and the communications module 32.

Figure 5:
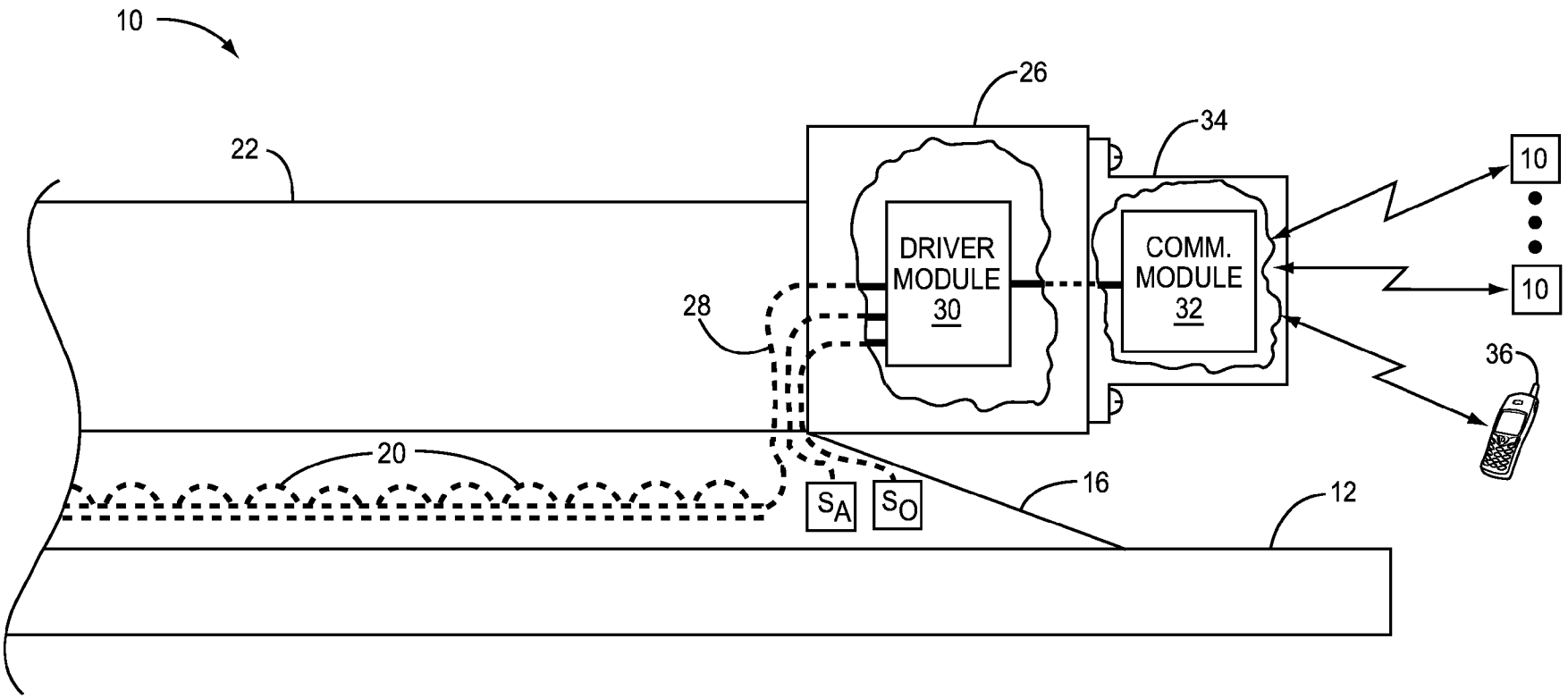
FIG. 5 illustrates a driver module provided in an electronics housing of the lighting fixture of FIG. 1 and a communications module in an associated housing coupled to the exterior of the electronics housing according to one embodiment of the disclosure.

With the embodiment of FIG. 4, adding or replacing the communications module 32 requires gaining access to the interior of the electronics housing 26. If this is undesirable, the driver module 30 may be provided alone in the electronics housing 26. The communications module 32 may be mounted outside of the electronics housing 26 in an exposed fashion or within a supplemental housing 34, which may be directly or indirectly coupled to the outside of the electronics housing 26, as shown in FIG. 5. The supplemental housing 34 may be bolted to the electronics housing 26. The supplemental housing 34 may alternatively be connected to the electronics housing using snap-fit or hook-and-snap mechanisms. The supplemental housing 34, alone or when coupled to the exterior surface of the electronics housing 26, may provide a plenum rated enclosure.

In embodiments where the electronics housing 26 and the supplemental housing 34 will be mounted within a plenum rated enclosure, the supplemental housing 34 may not need to be plenum rated. Further, the communications module 32 may be directly mounted to the exterior of the electronics housing 26 without any need for a supplemental housing 34, depending on the nature of the electronics provided in the communications module 32, how and where the lighting fixture 10 will be mounted, and the like. The latter embodiment wherein the communications module 32 is mounted outside of the electronics housing 26 may prove beneficial when the communications module 32 facilitates wireless communications with the other lighting fixtures 10, the remote control system, or other network or auxiliary device. In essence, the driver module 30 may be provided in the plenum rated electronics housing 26, which may not be conducive to wireless communications. The communications module 32 may be mounted outside of the electronics housing 26 by itself or within the supplemental housing 34 that is more conducive to wireless communications. A cable may be provided between the driver module 30 and the communications module 32 according to a defined communication interface. As an alternative, which is described in detail further below, the driver module 30 may be equipped with a first connector that is accessible through the wall of the electronics housing 26. The communications module 32 may have a second connector, which mates with the first connector to facilitate communications between the driver module 30 and the communications module 32.

The embodiments that employ mounting the communications module 32 outside of the electronics housing 26 may be somewhat less cost effective, but provide significant flexibility in allowing the communications module 32 or other auxiliary devices to be added to the lighting fixture 10, serviced, or replaced. The supplemental housing 34 for the communications module 32 may be made of a plenum rated plastic or metal, and may be configured to readily mount to the electronics housing 26 through snaps, screws, bolts, or the like, as well as receive the communications module 32. The communications module 32 may be mounted to the inside of the supplemental housing 34 through snap-fits, screws, twist-locks, and the like. The cabling and connectors used for connecting the communications module 32 to the driver module 30 may take any available form, such as with standard category 5/6 (cat 5/6) cable having RJ45 connectors, edge card connectors, blind mate connector pairs, terminal blocks and individual wires, and the like. Having an externally mounted communications module 32 relative to the electronics housing 26 that includes the driver module 30 allows for easy field installation of different types of communications modules 32 or modules with other functionality for a given driver module 30.

As illustrated in FIG. 5, the communications module 32 is mounted within the supplemental housing 34. The supplemental housing 34 is attached to the electronics housing 26 with bolts. As such, the communications module 32 is readily attached and removed via the illustrated bolts. Thus, a screwdriver, ratchet, or wrench, depending on the type of head for the bolts, is required to detach or remove the communications module 32 via the supplemental housing 34.

Figure 6A:
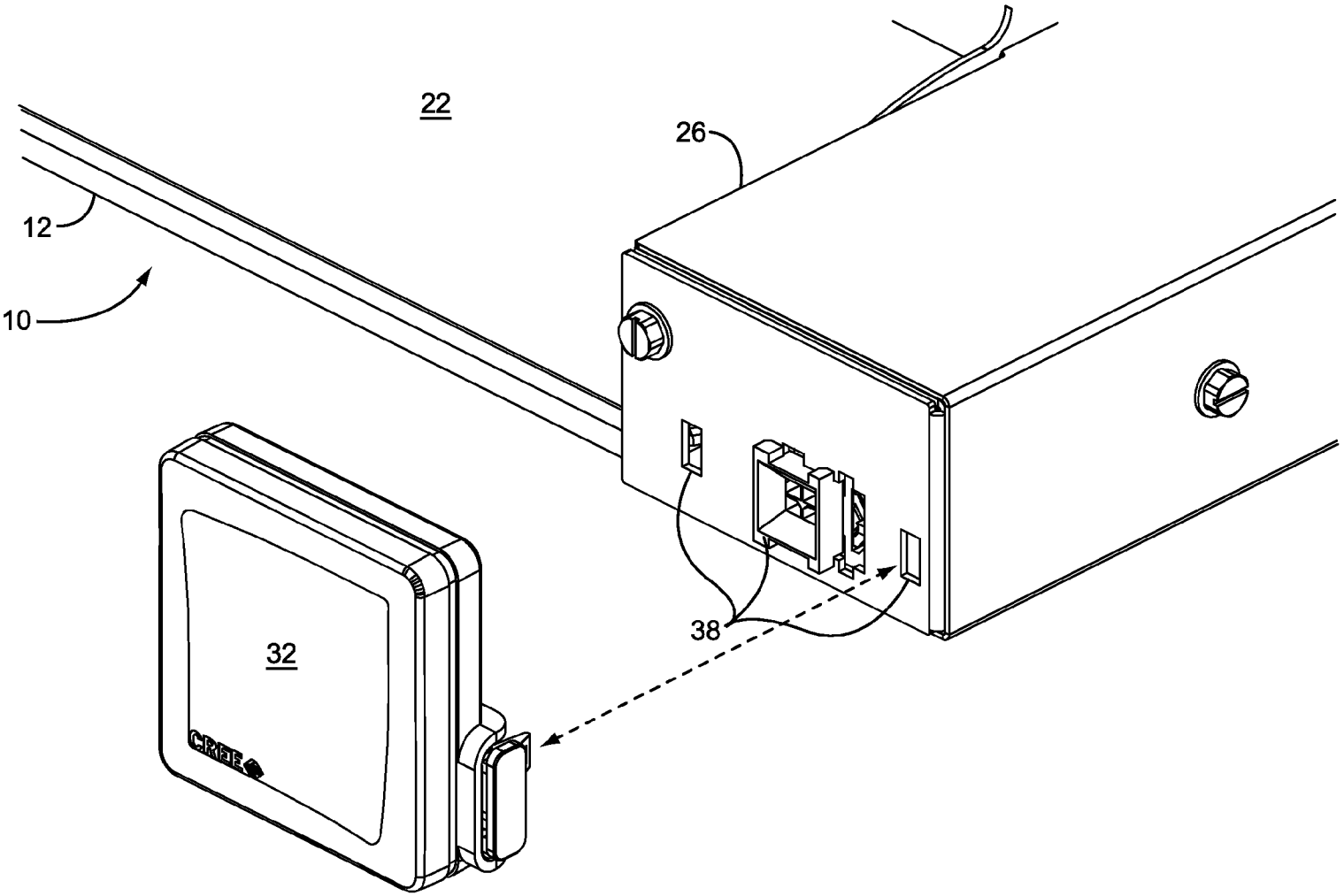
FIGS. 6A and 6B respectively illustrate a communications module according to one embodiment before and after being attached to the housing of the lighting fixture.
Figure 6B:
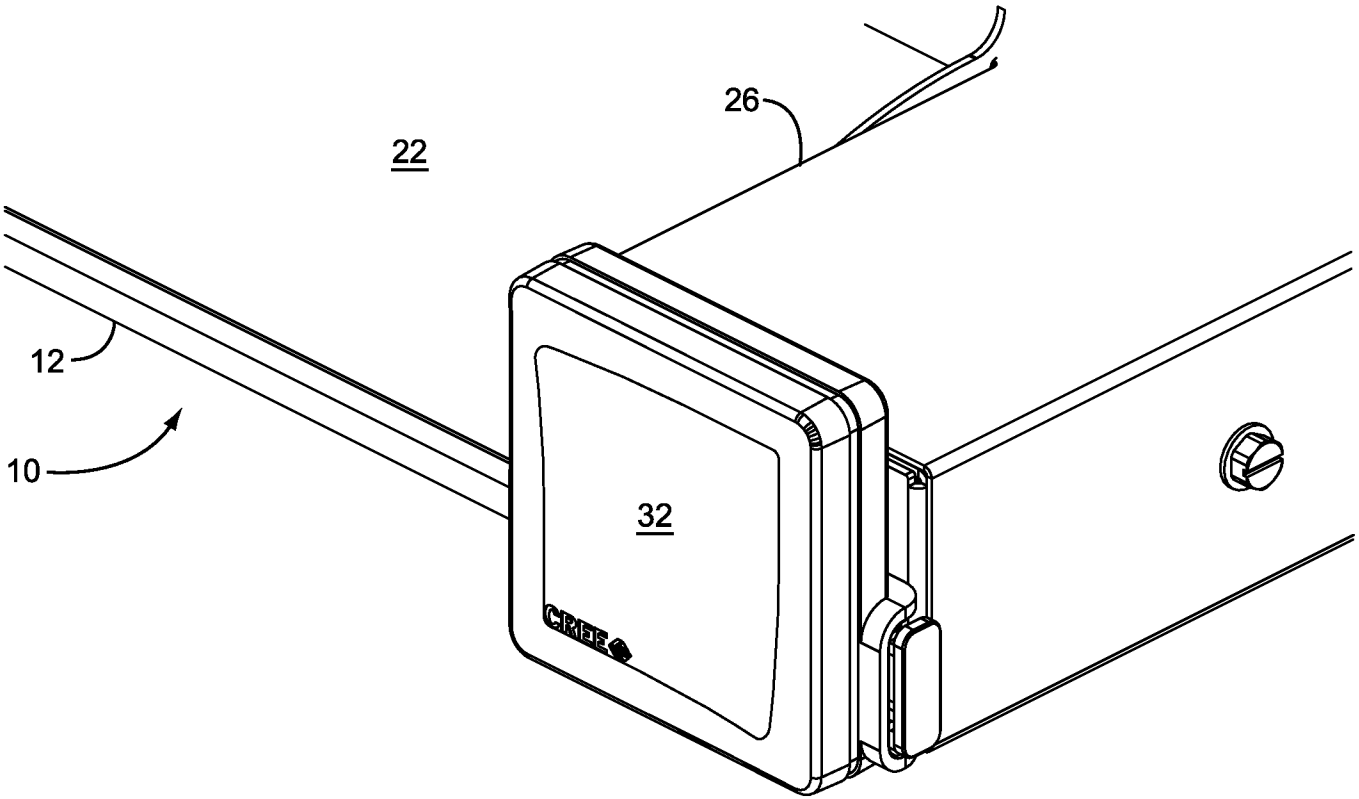

As an alternative, the communications module 32 may be configured as illustrated in FIGS. 6A and 6B. In this configuration, the communications module 32 may be attached to the electronics housing 26 of the lighting fixture 10 in a secure fashion and may subsequently be released from the electronics housing 26 without the need for bolts using available snap-lock connectors, such as illustrated in U.S. patent application Ser. No. 13/868,021, which was previously incorporated herein by reference. Notably, the rear of the communication module housing includes a male (or female) snap-lock connector (not shown), which is configured to securely and releasable engage a complementary female (or male) snap-lock connector 38 on the electronics housing 26.

FIG. 6A illustrates the communications module 32 prior to being attached to or just after being released from the electronics housing 26 of the lighting fixture 10. As illustrated, one surface of the electronics housing 26 of the lighting fixture 10 includes the snap-lock connector 38, which includes a female electrical connector that is flanked by openings that extend into the electronics housing 26 of the lighting fixture 10. The openings for correspond in size and location to the locking members (not shown) on the back of the communications module 32. Further, the female electrical connector leads to or is coupled to a PCB of the electronics for the driver module 30. In this example, the male electrical connector of the communications module 32 is configured to engage the female electrical connector, which is mounted in the electronics housing 26 of the lighting fixture 10.

As the communications module 32 is snapped into place on the electronics housing 26 of the lighting fixture 10, as illustrated in FIG. 6B, the male electrical connector of the communications module 32 will engage the female electrical connector of the driver module 30 as the fixture locking members of the communications module 32 engage the respective openings of the locking interfaces in the electronics housing 26. At this point, the communications module 32 is snapped into place to the electronics housing 26 of the lighting fixture 10, and the respective male and female connectors of the communications module 32 and the driver module 30 are fully engaged.

Figure 7:
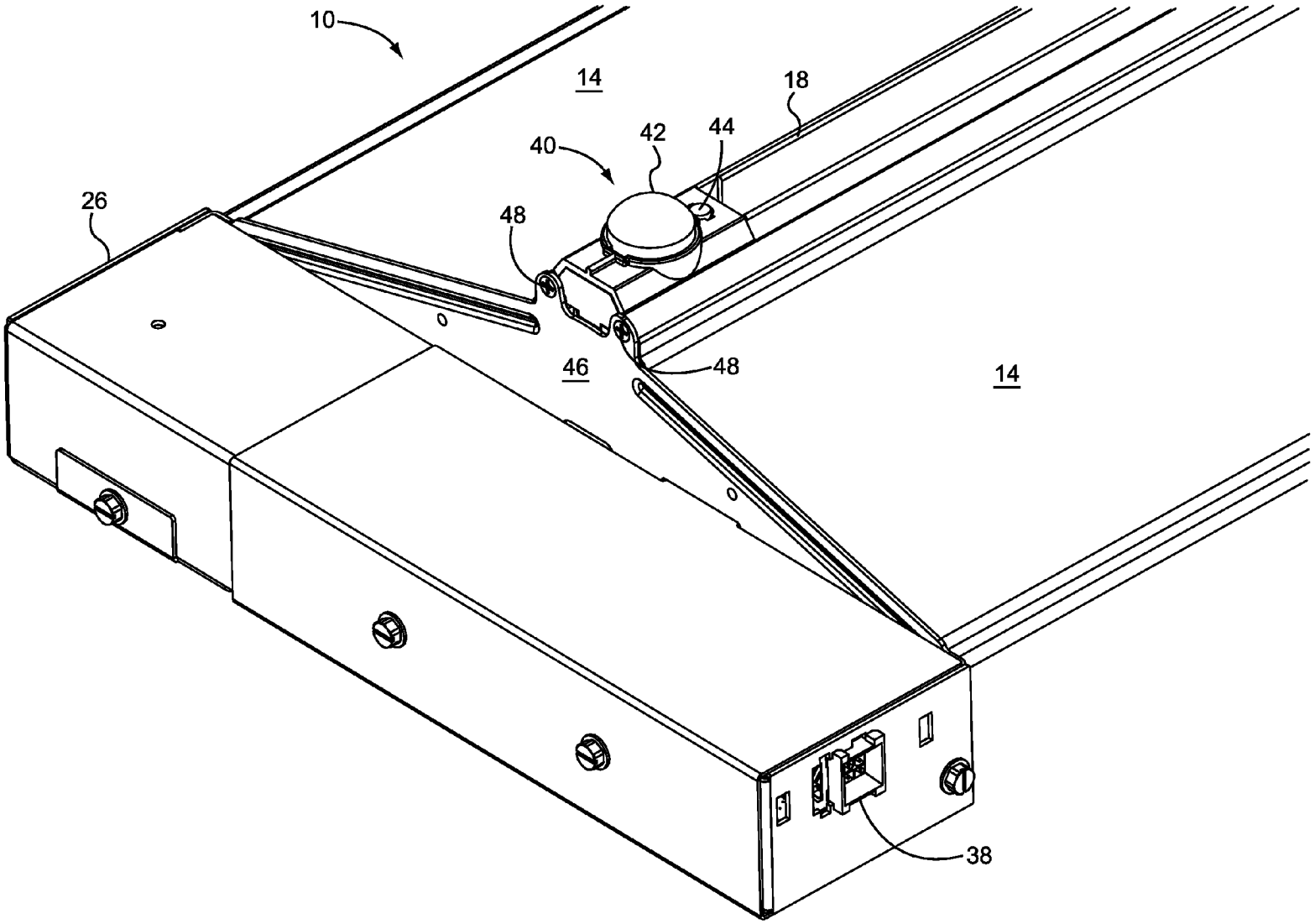
FIG. 7 illustrates a sensor module installed in a heatsink of a lighting fixture according to one embodiment of the disclosure.

With reference to FIG. 7, the bottom of one embodiment of the lighting fixture 10 is illustrated in a perspective view. In this embodiment, a sensor module 40 is shown integrated into exposed side of the heatsink 18 at one end of the heatsink 18. The sensor module 40 may include one or more sensors, such as occupancy sensors $S_O$, ambient light sensors $S_A$, temperature sensors, sound sensors (microphones), image (still or video) sensors, and the like. If multiple sensors are provided, they may be used to sense the same or different environmental conditions. If multiple sensors are used to sense the same environmental conditions, different types of sensors may be used.

As illustrated, the sensor module includes an occupancy sensor 42 and an ambient light sensor, which is internal to the occupancy and not visible in FIG. 7. The ambient light sensor is associated with a light pipe 44, which is used to guide light to the internal ambient light sensor. As described in greater detail below, the sensor module 40 may slide into the end of the heatsink 18 and be held in place by an end cap 46. The end cap 46 may be attached to the heatsink 18 using two screws 48. For the purposes of this description, the term "screw" is defined broadly to cover any externally threaded fastener, including traditional screws that cannot thread with a nut or tapped fixture and bolts that can thread with nuts or other tapped fixtures.

Figure 8A:
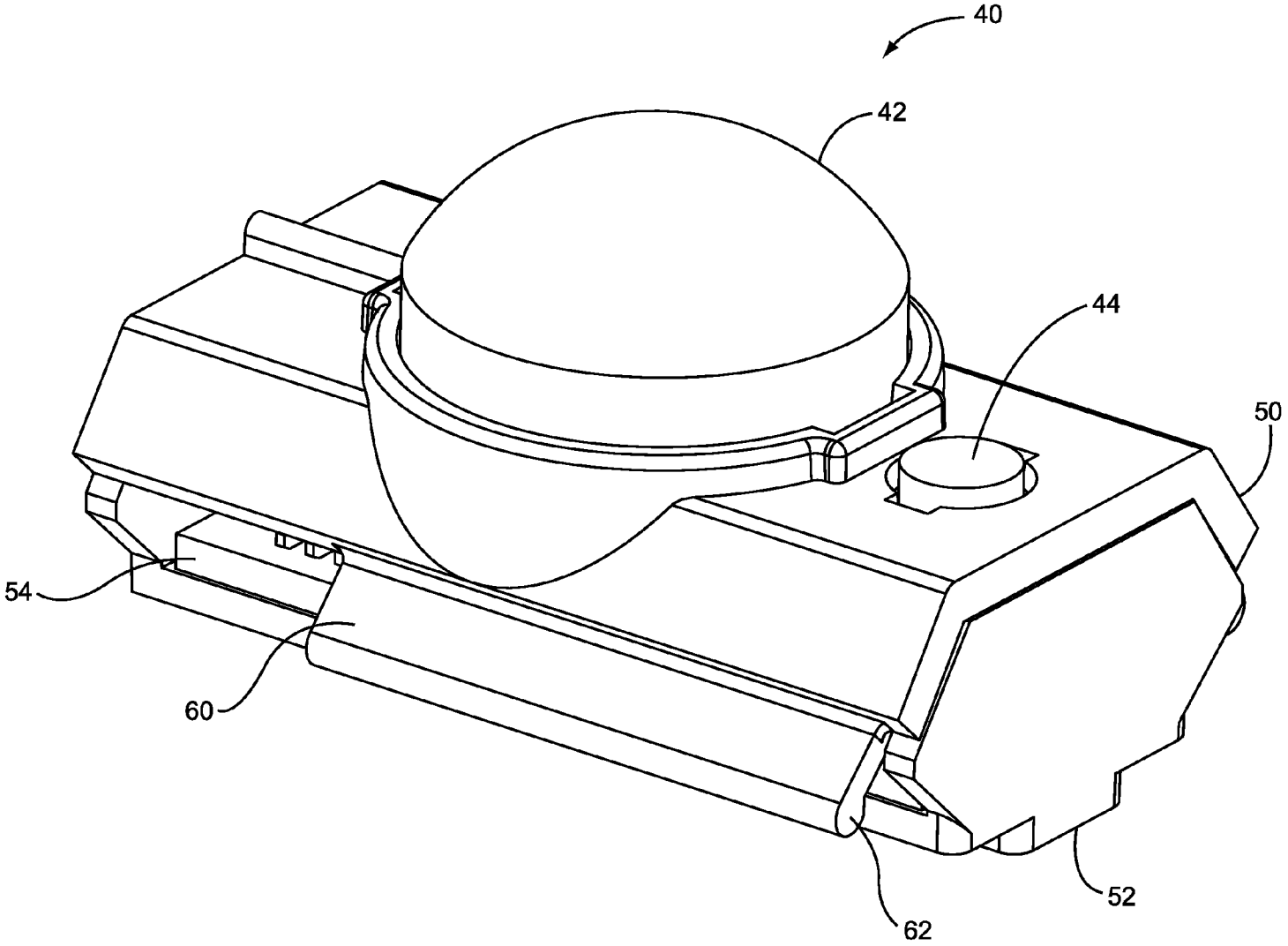
FIG. 8A illustrates a sensor module according to one embodiment of the disclosure.
Figure 8B:
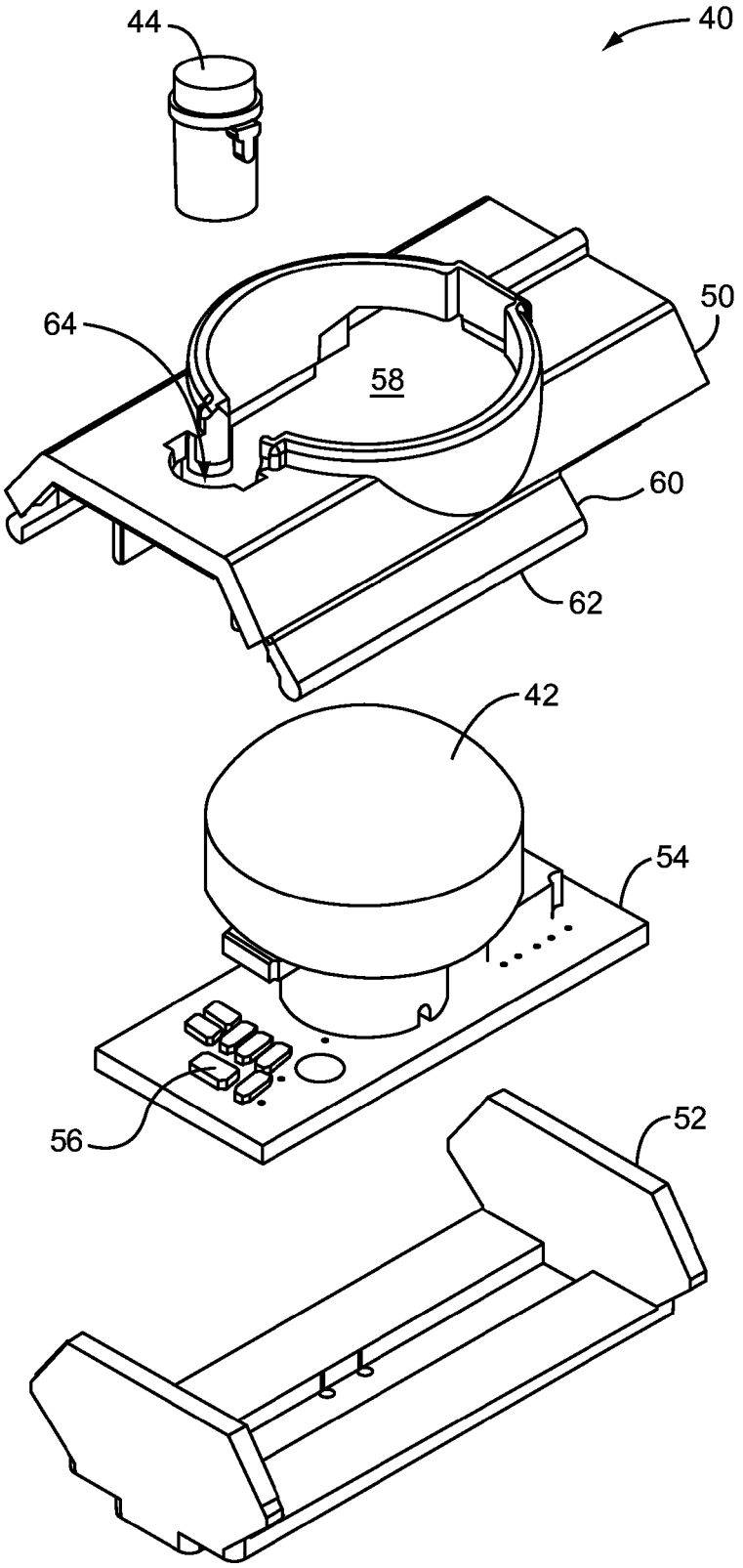
FIG. 8B is an exploded view of the sensor module of FIG. 8A.

FIGS. 8A and 8B illustrate one embodiment of the sensor module 40, which was introduced in FIG. 7. Primary reference is made to the exploded view of FIG. 8B. The sensor module 40 includes an upper housing 50 and a lower housing 52, which are configured to attach to one another through a snap-fit connector or other attachment mechanism, such as screws. A printed circuit board (PCB) 54 mounts inside of the sensor module 40, and the various sensors will mount to, or at least connect to, the PCB 54. In the illustrated embodiment, an ambient light sensor 56 and an occupancy sensor 42 are mounted to the printed circuit board. The ambient light sensor 56 is positioned such that it is aligned directly beneath the light pipe 44 when the light pipe 44 is inserted into a light pipe receptacle 64. The occupancy sensor 42 is aligned with an occupancy sensor opening 58 in the upper housing 50. Typically, the bulbous end of the occupancy sensor 42 extends into and partially through the sensor opening 58 when the sensor module 40 is assembled, as illustrated in FIG. 8A. In this example, the occupancy sensor 42 is an off-the-shelf passive infrared (PIR) occupancy sensor. The PCB 54 includes a connector, cabling, or wiring harness (not shown) that connects it directly or indirectly to the driver module 30 or the communications module 32.

The sensor module 40 may also include opposing mountings tabs 60, which are used to help attach the sensor module 40 to the heatsink 18. In this embodiment, the outer edge of the mounting tabs 60 expands to form a bulbous edge 62. Further details regarding the mounting tabs 60 and the bulbous edge 62 are described further below in association with FIGS. 10A through 10C.

Figure 9:
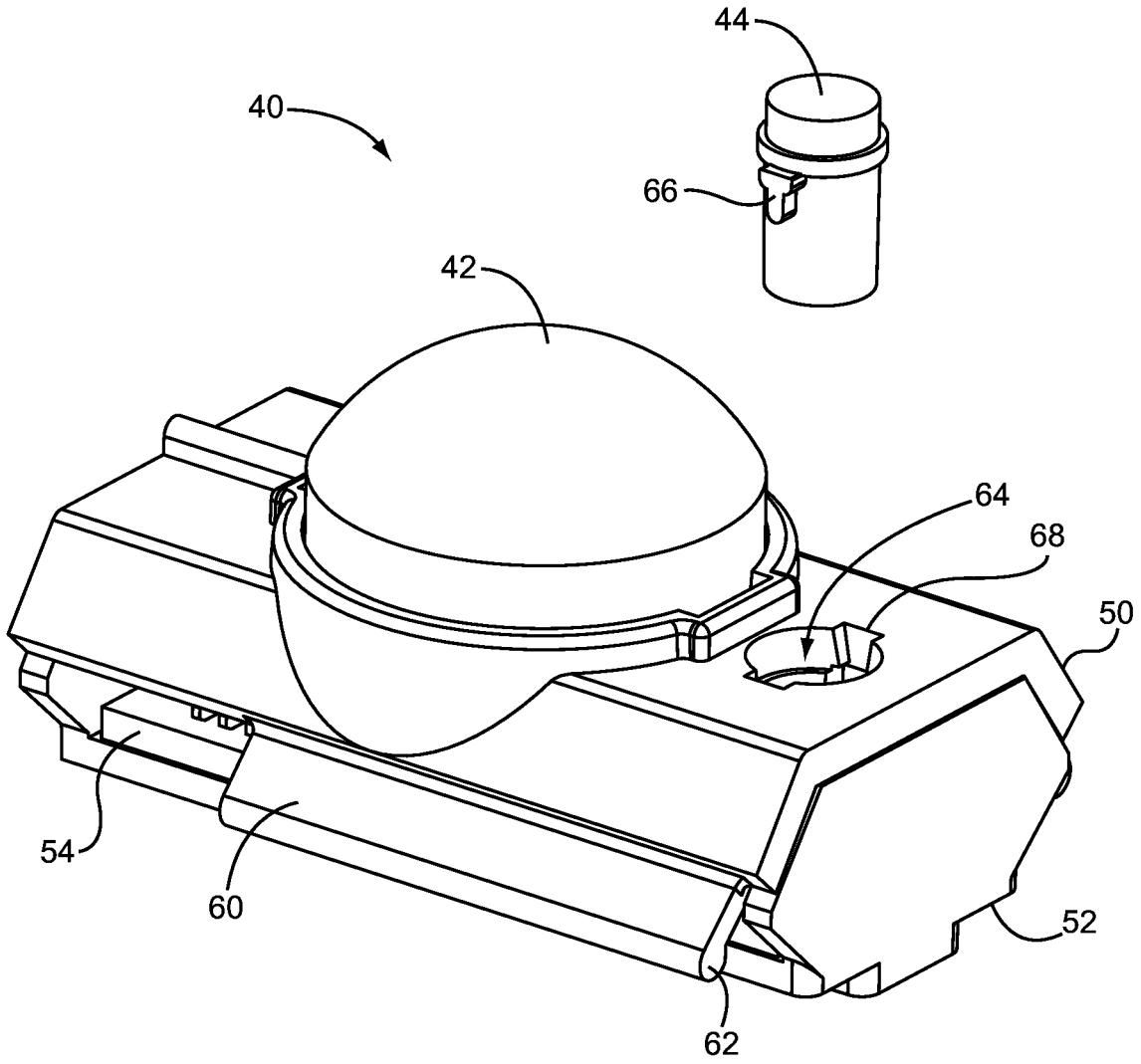
FIG. 9 illustrates a partial exploded view of the sensor module of FIG. 8A wherein the light pipe for an ambient light sensor is removed from its receptacle.

As illustrated in FIG. 9, the light pipe 44 may snap into place in the light pipe receptacle 64. While many variants are possible, the side of the light pipe 44 may include one or more male snap-fit features 66, which are designed to releasably engage corresponding female snap-fit features 68. As illustrated, the light pipe has two opposing male snap-fit features 66 (where only one is visible), and the upper housing 50 has two corresponding female snap-fit features 68.

The light pipe 44 is solid (as opposed to hollow) and may be formed from acrylic, polymer, glass, or the like. The light pipe 44 may include or be formed to provide various types of filtering. Further, different lengths, configurations, and materials for the light pipe 44 may provide different optical coverage and/or filtering for different light pipes 44 that fit the same light pipe receptacle 64. Light pipes 44 with different optical characteristics, but the same general form factor may be used with a given sensor module 40. As such, the light pipe 44 may be specially selected from a number of different light pipes 44 to optimize the ambient light performance of the ambient light sensor 56 for a particular installation or environment.

Figure 10A:
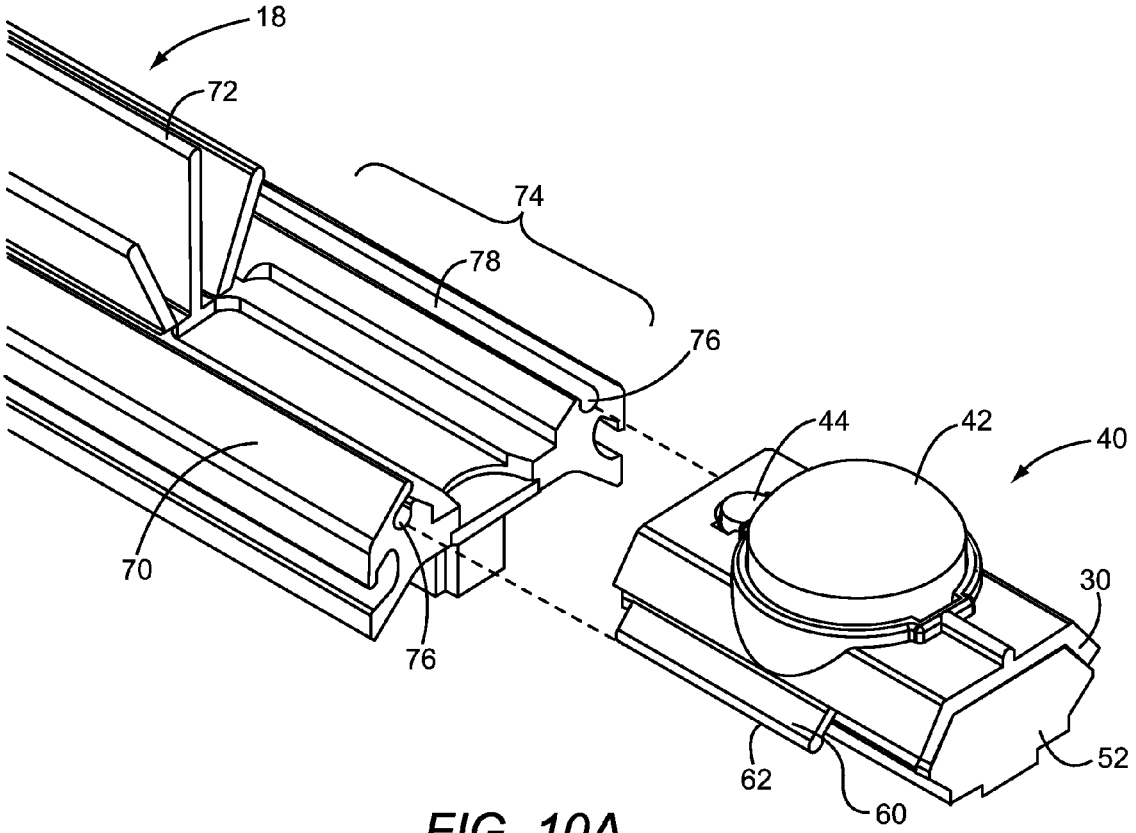
FIGS. 10A, 10B, and 10C illustrate installation of the sensor module into to a heatsink according to one embodiment.
Figure 10B:
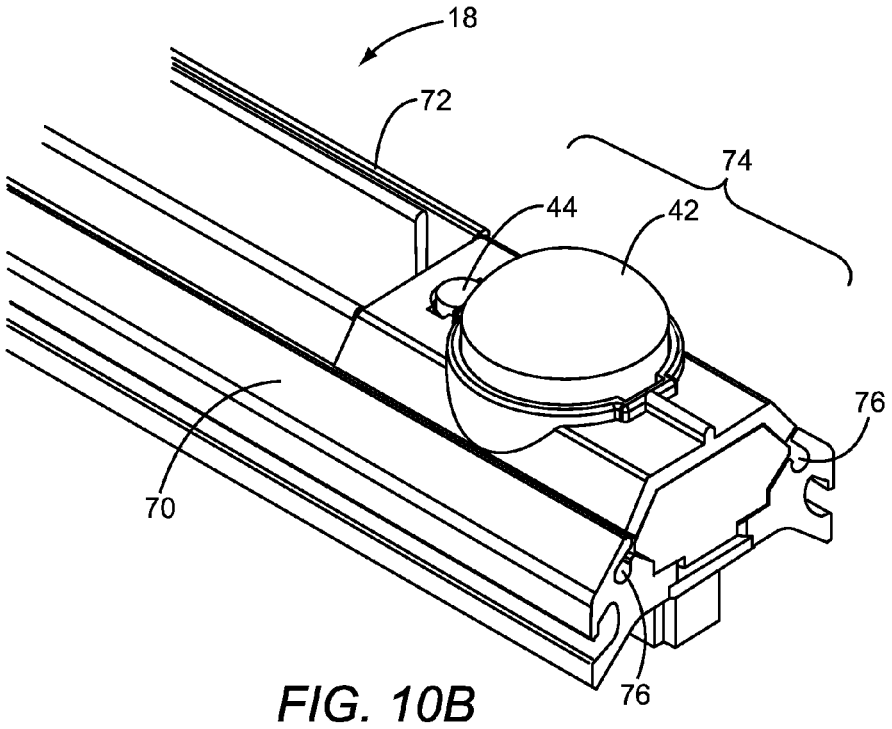
Figure 10C:
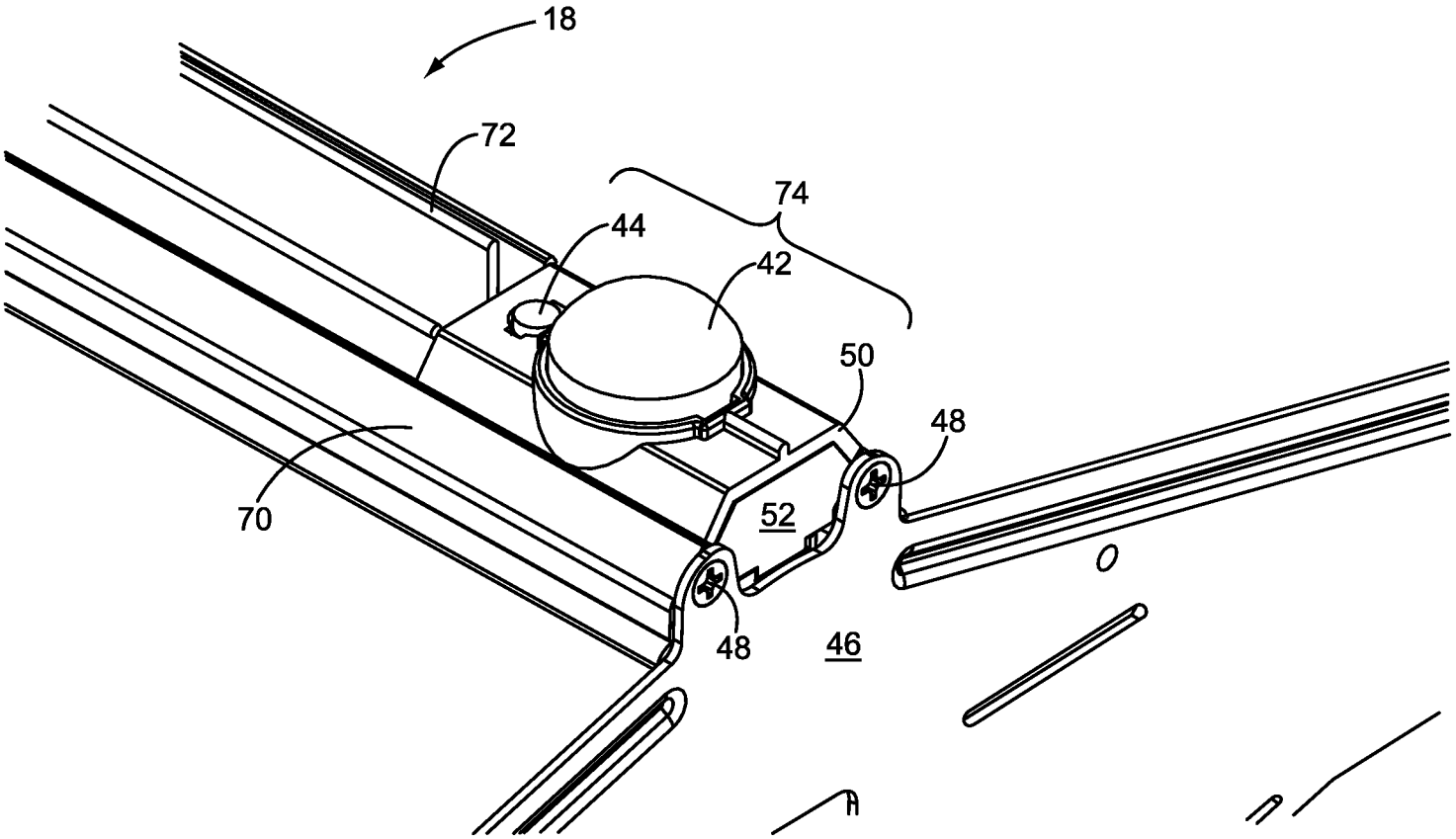
Figure 11:
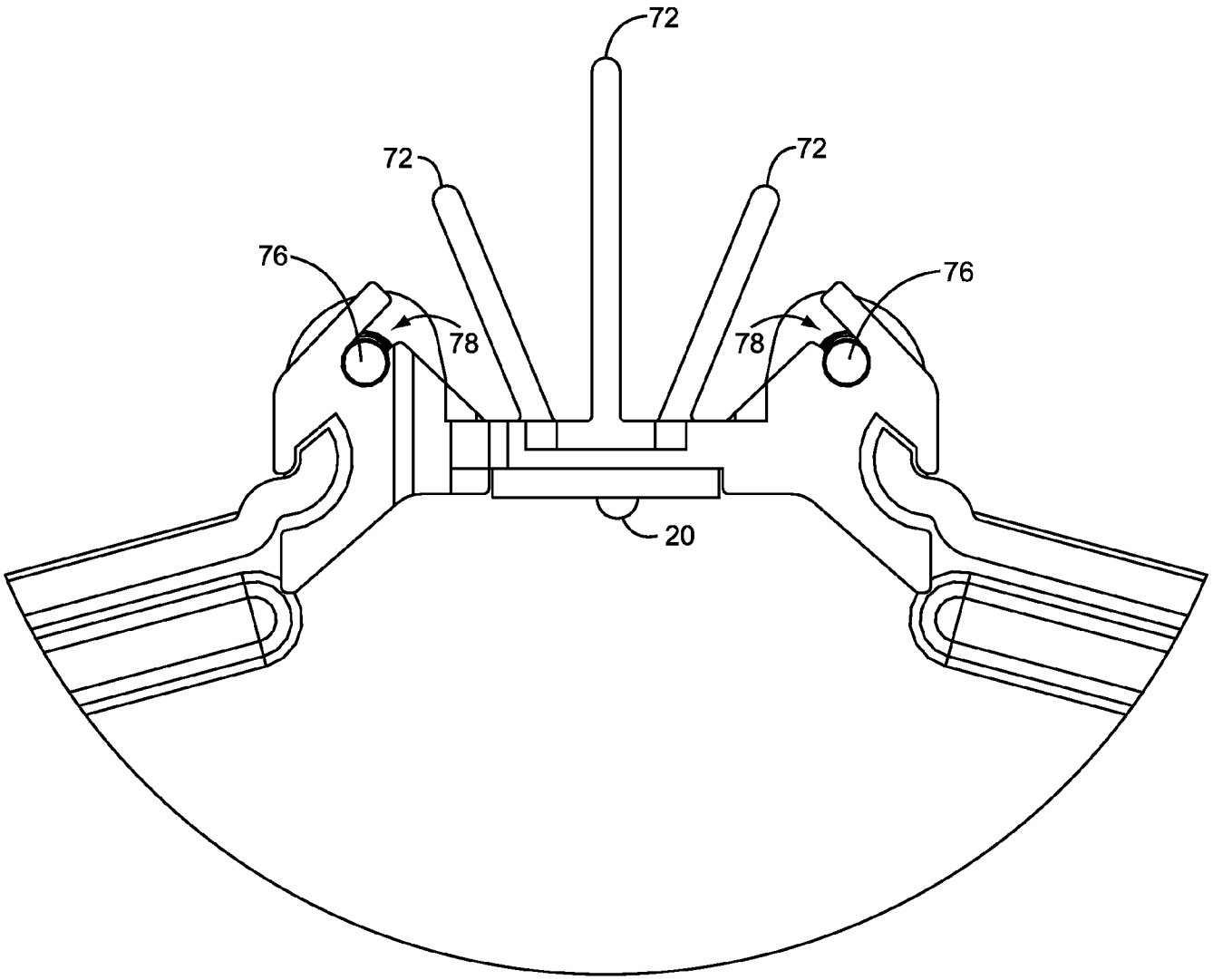
FIG. 11 is an end view of the heatsink, without the sensor module installed, according to one embodiment.

FIGS. 10A through 10C and FIG. 11 illustrate how the sensor module 40 and the end of the heatsink 18 are configured to allow the sensor module 40 to be readily installed and held into place on the heatsink 18. With reference to FIGS. 10A and 11, which is an end view of the heatsink 18 without the sensor module 40 installed, the sensor module 40 is shown just prior to being slid into the end of the heatsink 18. The heatsink 18 includes a main body 70, fins 72, and a sensor recess 74, which is configured to receive the sensor module 40. In this embodiment, partially open bosses 76 are provided along either side of the sensor recess 74. The partially open bosses 76 are essentially deep holes that extend into the end of the heatsink 18 and have an elongated slot 78 that extends along all or a portion of the sides of the holes.

The bulbous edge 62 of each mounting tab 60 of the sensor module 40 are sized and shaped to slide into a corresponding hole of each partially open boss 76. Effectively, the partially open bosses 76 form channels that are configured to receive the mounting tabs 60 of the of the sensor module 40. FIG. 10B illustrates the sensor module 40 after it is axially slid into the end of the heatsink 18 and into position within the sensor recess 74. In this position, each mounting tab 60 extends through the slot 78 of one of the partially open bosses 76, and the bulbous edge 62 of each of the mounting tabs 60 resides within the hole of the corresponding partially open boss 76.

The partially open bosses 76 and the mounting tabs 60 are configured to prevent the sensor module 40 from being removed from the sensor recess 74 radially while allowing it to slide in and out of the sensor recess 74 axially. As shown in FIG. 10C, the end cap 46 may be configured to attach to the end of the heatsink 18 and extend over at least a portion of the side of the sensor recess 74. As such, the end cap 46 will provide a barrier, along the end of the heatsink 18, to hold the sensor module 40 in place within the sensor recess 74.

In this embodiment, at least an outer portion of each hole of the partially open bosses 76 is threaded to receive an end cap mounting screw 48. The end cap 46 includes holes that align with the partially open bosses 76 and are large enough to receive the body of the end cap mounting screws 48. Thus, the end cap mounting screws 48 thread into the partially open bosses 76 to attach the end cap 46 to the end of the heatsink 18. The end cap 46 in turn keeps the sensor module 40 from axially sliding out of the sensor recess 74. Again, the mounting tabs 60 keep the sensor module 40 from radially sliding out of the sensor recess 74. Those skilled on the art will recognize other techniques for removably attaching the sensor module 40 to the heatsink 18 or other parts of the lighting fixture 10.

When aesthetics are important, the exposed surfaces of the sensor module 40, such as the upper housing 50, are shaped to allow the sensor module 40 to aesthetically blend in with the heatsink 18. In the illustrated embodiments, the angled side walls of the upper housing 50 of the sensor module 40 continue the plane of the angled side walls of the main body 70 of the heatsink 18. The transition point between the angled side walls and the surface extending between the side walls of the upper housing 50 aligns with the outer fins 72 of the heatsink 18. The upper and lower housings 50, 52 of the sensor module 40 may have the same color as the heatsink 18. The materials used to form the upper and lower housings 50, 52 may be metal, plastic, or the like. If formed from conductive materials, the PCB 54 will need to be electrically isolated from the upper and lower housings 50, 52. If formed from insulator materials, the upper and lower housings 50, 52 will provide electrical insulation for the PCB 54, occupancy sensor 42, ambient light sensor 56, and any other electrical components.

Figure 12:
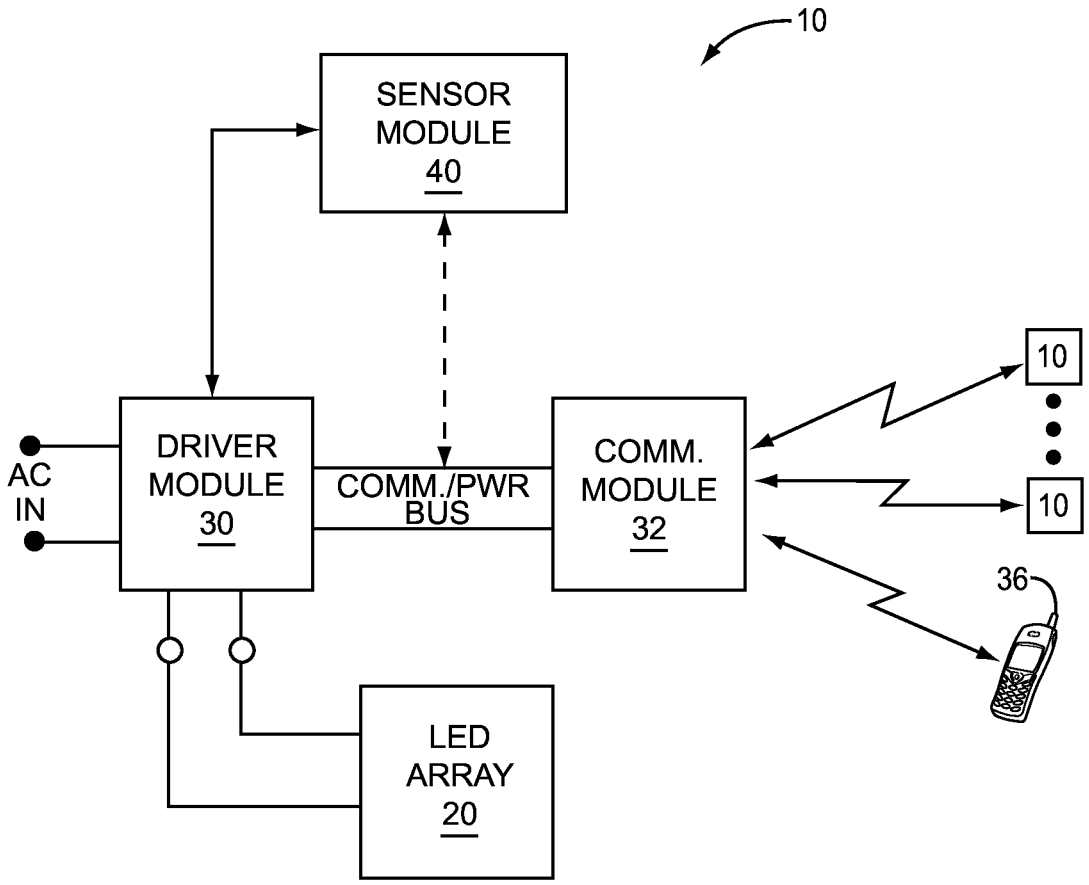
FIG. 12 is a block diagram of a lighting system according to one embodiment of the disclosure.

Turning now to FIG. 12, a block diagram of a lighting fixture 10 is provided according to one embodiment. Assume for purposes of discussion that the driver module 30, communications module 32, and LED array 20 are ultimately connected to form the core of the lighting fixture 10, and that the communications module 32 is configured to bidirectionally communicate with other lighting fixtures 10, the commissioning tool 36, or other control entity through wired or wireless techniques. In this embodiment, a standard communication interface and a first, or standard, protocol are used between the driver module 30 and the communications module 32. This standard protocol allows different driver modules 30 to communicate with and be controlled by different communications modules 32, assuming that both the driver module 30 and the communications module 32 are operating according to the standard protocol used by the standard communication interface. The term "standard protocol" is defined to mean any type of known or future developed, proprietary or industry-standardized protocol.

In the illustrated embodiment, the driver module 30 and the communications module 32 are coupled via communication and power buses, which may be separate or integrated with one another. The communication bus allows the communications module 32 to receive information from the driver module 30 as well as control the driver module 30. An exemplary communication bus is the well-known inter-integrated circuitry ($I^2C$) bus, which is a serial bus and is typically implemented with a two-wire interface employing data and clock lines. Other available buses include: serial peripheral interface (SPI) bus, Dallas Semiconductor Corporation's 1-Wire serial bus, universal serial bus (USB), RS-232, Microchip Technology Incorporated's UNI/O®, and the like.

In this embodiment, the driver module 30 is configured to collect data from the ambient light sensor $S_A$ and the occupancy sensor $S_O$ and drive the LEDs of the LED array 20. The data collected from the ambient light sensor $S_A$ and the occupancy sensor $S_O$ as well as any other operational parameters of the driver module 30 may be shared with the communications module 32. As such, the communications module 32 may collect data about the configuration or operation of the driver module 30 and any information made available to the driver module 30 by the LED array 20, the ambient light sensor $S_A$, and the occupancy sensor $S_O$. The collected data may be used by the communications module 32 to control how the driver module 30 operates, may be shared with other lighting fixtures 10 or control entities, or may be processed to generate instructions that are sent to other lighting fixtures 10. Notably, the sensor module 40 may be coupled to the communications bus instead of directly to the driver module 30, such that sensor information from the sensor module 40 may be provided to the driver module 30 or the communications module 32 via the communications bus.

The communications module 32 may also be controlled in whole or in part by a remote control entity, such as the commissioning tool 36 or another lighting fixture 10. In general, the communications module 32 will process sensor data and instructions provided by the other lighting fixtures 10 or remote control entities and then provide instructions over the communication bus to the driver module 30. An alternative way of looking at it is that the communications module 32 facilitates the sharing of the system's information, including occupancy sensing, ambient light sensing, dimmer switch settings, etc., and provides this information to the driver module 30, which then uses its own internal logic to determine what action(s) to take. The driver module 30 will respond by controlling the drive current or voltages provided to the LED array 20 as appropriate.

In certain embodiments, the driver module 30 includes sufficient electronics to process an alternating current (AC) input signal (AC IN) and provide an appropriate rectified or direct current (DC) signal sufficient to power the communications module 32, and perhaps the LED array 20. As such, the communications module 32 does not require separate AC-to-DC conversion circuitry to power the electronics residing therein, and can simply receive DC power from the driver module 30 over the power bus. Similarly, the sensor module 40 may receive power directly from the driver module 30 or via the power bus, which is powered by the driver module 30 or other source. The sensor module 40 may also be coupled to a power source independently of the driver and communications modules 30, 32.

In one embodiment, one aspect of the standard communication interface is the definition of a standard power delivery system. For example, the power bus may be set to a low voltage level, such as 5 volts, 12 volts, 24 volts, or the like. The driver module 30 is configured to process the AC input signal to provide the defined low voltage level and provide that voltage over the power bus, thus the communications module 32 or auxiliary devices, such as the sensor module 40, may be designed in anticipation of the desired low voltage level being provided over the power bus by the driver module 30 without concern for connecting to or processing an AC signal to a DC power signal for powering the electronics of the communications module 32 or the sensor module 40.

Figure 13:
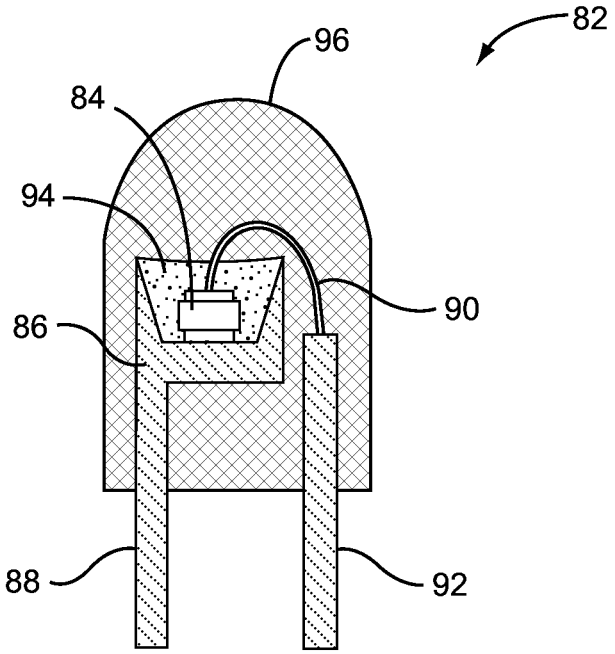
FIG. 13 is a cross section of an exemplary LED according to a first embodiment of the disclosure.

A description of an exemplary embodiment of the LED array 20, driver module 30, and the communications module 32 follows. As noted, the LED array 20 includes a plurality of LEDs, such as the LEDs 82 illustrated in FIGS. 13 and 14. With reference to FIG. 13, a single LED chip 84 is mounted on a reflective cup 86 using solder or a conductive epoxy, such that ohmic contacts for the cathode (or anode) of the LED chip 84 are electrically coupled to the bottom of the reflective cup 86. The reflective cup 86 is either coupled to or integrally formed with a first lead 88 of the LED 82. One or more bond wires 90 connect ohmic contacts for the anode (or cathode) of the LED chip 84 to a second lead 92.

The reflective cup 86 may be filled with an encapsulant material 94 that encapsulates the LED chip 84. The encapsulant material 94 may be clear or contain a wavelength conversion material, such as a phosphor, which is described in greater detail below. The entire assembly is encapsulated in a clear protective resin 96, which may be molded in the shape of a lens to control the light emitted from the LED chip 84.

Figure 14:
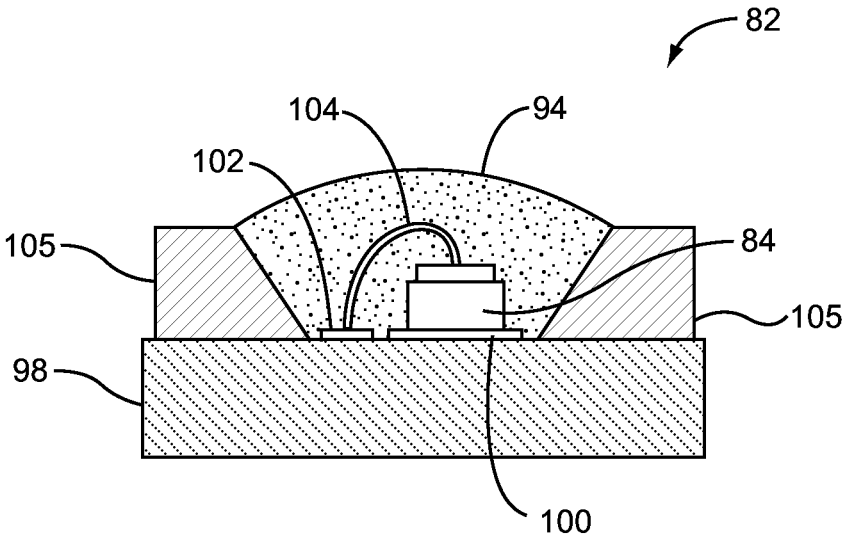
FIG. 14 is a cross section of an exemplary LED according to a second embodiment of the disclosure.

An alternative package for an LED 82 is illustrated in FIG. 14 wherein the LED chip 84 is mounted on a substrate 98. In particular, the ohmic contacts for the anode (or cathode) of the LED chip 84 are directly mounted to first contact pads 100 on the surface of the substrate 98. The ohmic contacts for the cathode (or anode) of the LED chip 84 are connected to second contact pads 102, which are also on the surface of the substrate 98, using bond wires 104. The LED chip 84 resides in a cavity of a reflector structure 105, which is formed from a reflective material and functions to reflect light emitted from the LED chip 84 through the opening formed by the reflector structure 105. The cavity formed by the reflector structure 105 may be filled with an encapsulant material 94 that encapsulates the LED chip 84. The encapsulant material 94 may be clear or contain a wavelength conversion material, such as a phosphor.

In either of the embodiments of FIGS. 13 and 14, if the encapsulant material 94 is clear, the light emitted by the LED chip 84 passes through the encapsulant material 94 and the protective resin 96 without any substantial shift in color. As such, the light emitted from the LED chip 84 is effectively the light emitted from the LED 82. If the encapsulant material 94 contains a wavelength conversion material, substantially all or a portion of the light emitted by the LED chip 84 in a first wavelength range may be absorbed by the wavelength conversion material, which will responsively emit light in a second wavelength range. The concentration and type of wavelength conversion material will dictate how much of the light emitted by the LED chip 84 is absorbed by the wavelength conversion material as well as the extent of the wavelength conversion. In embodiments where some of the light emitted by the LED chip 84 passes through the wavelength conversion material without being absorbed, the light passing through the wavelength conversion material will mix with the light emitted by the wavelength conversion material. Thus, when a wavelength conversion material is used, the light emitted from the LED 82 is shifted in color from the actual light emitted from the LED chip 84.

For example, the LED array 20 may include a group of BSY or BSG LEDs 82 as well as a group of red LEDs 82. BSY LEDs 82 include an LED chip 84 that emits bluish light, and the wavelength conversion material is a yellow phosphor that absorbs the blue light and emits yellowish light. Even if some of the bluish light passes through the phosphor, the resultant mix of light emitted from the overall BSY LED 82 is yellowish light. The yellowish light emitted from a BSY LED 82 has a color point that falls above the Black Body Locus (BBL) on the 1931 CIE chromaticity diagram wherein the BBL corresponds to the various color temperatures of white light.

Similarly, BSG LEDs 82 include an LED chip 84 that emits bluish light; however, the wavelength conversion material is a greenish phosphor that absorbs the blue light and emits greenish light. Even if some of the bluish light passes through the phosphor, the resultant mix of light emitted from the overall BSG LED 82 is greenish light. The greenish light emitted from a BSG LED 82 has a color point that falls above the BBL on the 1931 CIE chromaticity diagram wherein the BBL corresponds to the various color temperatures of white light.

The red LEDs 82 generally emit reddish light at a color point on the opposite side of the BBL as the yellowish or greenish light of the BSY or BSG LEDs 82. As such, the reddish light from the red LEDs 82 mixes with the yellowish or greenish light emitted from the BSY or BSG LEDs 82 to generate white light that has a desired color temperature and falls within a desired proximity of the BBL. In effect, the reddish light from the red LEDs 82 pulls the yellowish or greenish light from the BSY or BSG LEDs 82 to a desired color point on or near the BBL. Notably, the red LEDs 82 may have LED chips 84 that natively emit reddish light wherein no wavelength conversion material is employed. Alternatively, the LED chips 84 may be associated with a wavelength conversion material, wherein the resultant light emitted from the wavelength conversion material and any light that is emitted from the LED chips 84 without being absorbed by the wavelength conversion material mixes to form the desired reddish light.

The blue LED chip 84 used to form either the BSY or BSG LEDs 82 may be formed from a gallium nitride (GaN), indium gallium nitride (InGaN), silicon carbide (SiC), zinc selenide (ZnSe), or like material system. The red LED chip 84 may be formed from an aluminum indium gallium nitride (AlInGaP), gallium phosphide (GaP), aluminum gallium arsenide (AlGaAs), or like material system. Exemplary yellow phosphors include cerium-doped yttrium aluminum garnet (YAG:Ce), yellow BOSE (Ba, O, Sr, Si, Eu) phosphors, and the like. Exemplary green phosphors include green BOSE phosphors, Lutetium aluminum garnet (LuAg), cerium doped LuAg (LuAg:Ce), Maui M535 from Lightscape Materials, Inc. of 201 Washington Road, Princeton, N.J. 08540, and the like. The above LED architectures, phosphors, and material systems are merely exemplary and are not intended to provide an exhaustive listing of architectures, phosphors, and materials systems that are applicable to the concepts disclosed herein.

Figure 15:
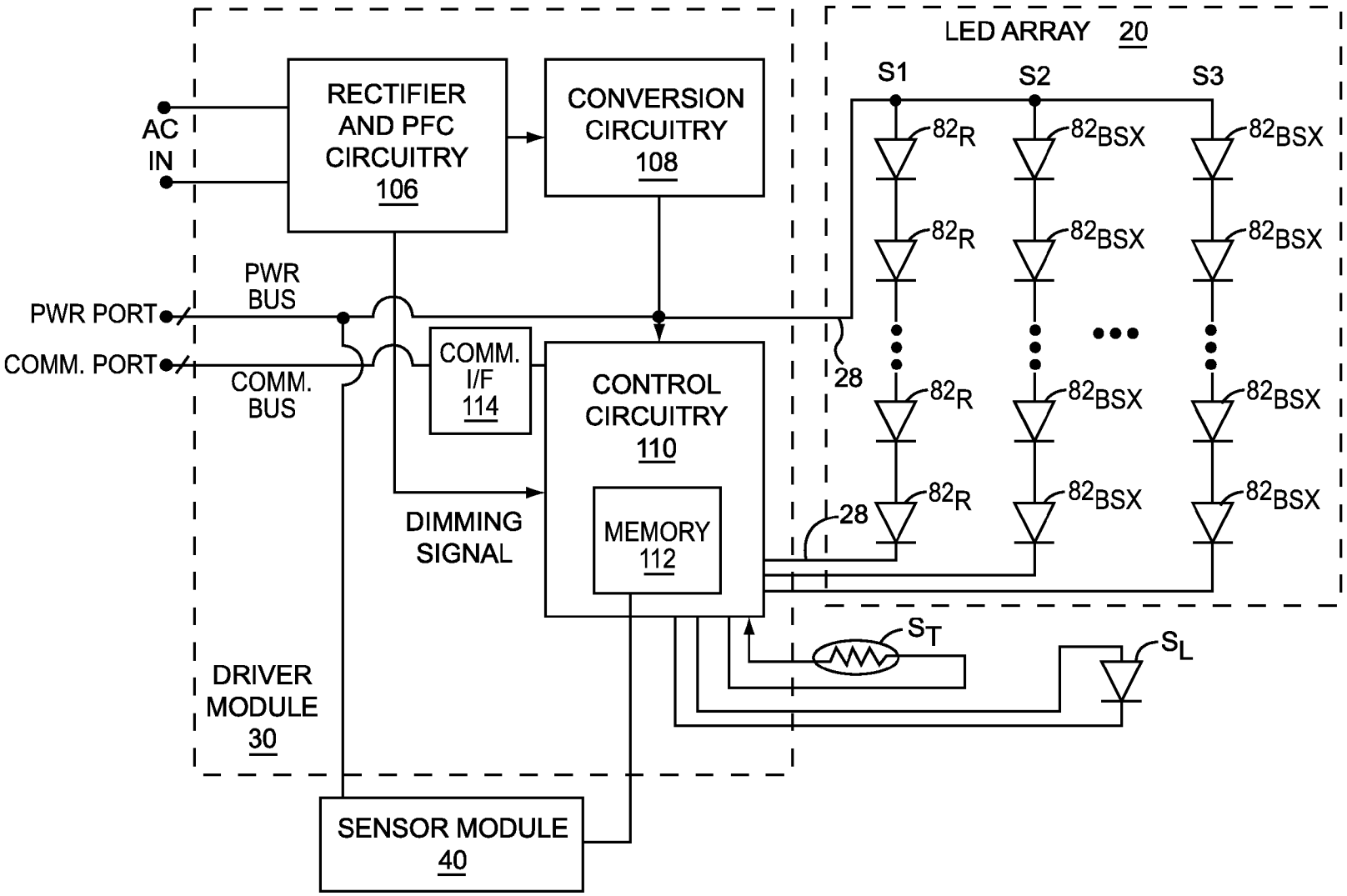
FIG. 15 is a schematic of a driver module and an LED array according to one embodiment of the disclosure.

As noted, the LED array 20 may include a mixture of red LEDs 82 and either BSY or BSG LEDs 82. The driver module 30 for driving the LED array 20 is illustrated in FIG. 15 according to one embodiment of the disclosure. The LED array 20 may be electrically divided into two or more strings of series connected LEDs 82. As depicted, there are three LED strings S1, S2, and S3. For clarity, the reference number "82" will include a subscript indicative of the color of the LED 82 in the following text where 'IR' corresponds to red, 'BSY' corresponds to blue shifted yellow, 'BSG' corresponds to blue shifted green, and 'BSX' corresponds to either BSG or BSY LEDs. LED string S1 includes a number of red LEDs $82_R$, LED string S2 includes a number of either BSY or BSG LEDs $82_{BSX}$, and LED string S3 includes a number of either BSY or BSG LEDs $82_{BSX}$. The driver module 30 controls the current delivered to the respective LED strings S1, S2, and S3. The current used to drive the LEDs 82 is generally pulse width modulated (PWM), wherein the duty cycle of the pulsed current controls the intensity of the light emitted from the LEDs 82.

The BSY or BSG LEDs $82_{BSX}$ in the second LED string S2 may be selected to have a slightly more bluish hue (less yellowish or greenish hue) than the BSY or BSG LEDs $82_{BSX}$ in the third LED string S3. As such, the current flowing through the second and third strings S2 and S3 may be tuned to control the yellowish or greenish light that is effectively emitted by the BSY or BSG LEDs $82_{BSX}$ of the second and third LED strings S2, S3. By controlling the relative intensities of the yellowish or greenish light emitted from the differently hued BSY or BSG LEDs $82_{BSX}$ of the second and third LED strings S2, S3, the hue of the combined yellowish or greenish light from the second and third LED strings S2, S3 may be controlled in a desired fashion.

The ratio of current provided through the red LEDs $82_R$ of the first LED string S1 relative to the currents provided through the BSY or BSG LEDs $82_{BSX}$ of the second and third LED strings S2 and S3 may be adjusted to effectively control the relative intensities of the reddish light emitted from the red LEDs $82_R$ and the combined yellowish or greenish light emitted from the various BSY or BSG LEDs $82_{BSX}$. As such, the intensity and the color point of the yellowish or greenish light from BSY or BSG LEDs $82_{BSX}$ can be set relative to the intensity of the reddish light emitted from the red LEDs $82_R$. The resultant yellowish or greenish light mixes with the reddish light to generate white light that has a desired color temperature and falls within a desired proximity of the BBL.

Notably, the number of LED strings Sx may vary from one to many and different combinations of LED colors may be used in the different strings. Each LED string Sx may have LEDs 82 of the same color, variations of the same color, or substantially different colors, such as red, green, and blue. In one embodiment, a single LED string may be used, wherein the LEDs in the string are all substantially identical in color, vary in substantially the same color, or include different colors. In another embodiment, three LED strings Sx with red, green, and blue LEDs may be used, wherein each LED string Sx is dedicated to a single color. In yet another embodiment, at least two LED strings Sx may be used, wherein different colored BSY LEDs are used in one of the LED strings Sx and red LEDs are used in the other of the LED strings Sx.

The driver module 30 depicted in FIG. 15 generally includes rectifier and power factor correction (PFC) circuitry 106, conversion circuitry 108, and control circuitry 110. The rectifier and power factor correction circuitry 106 is adapted to receive an AC power signal (AC IN), rectify the AC power signal, and correct the power factor of the AC power signal. The resultant signal is provided to the conversion circuitry 108, which converts the rectified AC power signal to a DC power signal. The DC power signal may be boosted or bucked to one or more desired DC voltages by DC-DC converter circuitry, which is provided by the conversion circuitry 108. Internally, The DC power signal may be used to directly power the control circuitry 110 and any other circuitry provided in the driver module 30 as well as the sensor module 40.

The DC power signal is also provided to the power bus, which is coupled to one or more power ports, which may be part of the standard communication interface. The DC power signal provided to the power bus may be used to provide power to one or more external devices that are coupled to the power bus and separate from the driver module 30. These external devices may include the communications module 32 and any number of auxiliary devices, such as the sensor module 40. Accordingly, these external devices may rely on the driver module 30 for power and can be efficiently and cost effectively designed accordingly. The rectifier and PFC circuitry 106 and the conversion circuitry 108 of the driver module 30 are robustly designed in anticipation of being required to supply power to not only its internal circuitry and the LED array 20, but also to supply power to these external devices. Such a design greatly simplifies the power supply design, if not eliminating the need for a power supply, and reduces the cost for these external devices.

As illustrated, the DC power signal may be provided to another port, which will be connected by the cabling 28 to the LED array 20. In this embodiment, the supply line of the DC power signal is ultimately coupled to the first end of each of the LED strings S1, S2, and S3 in the LED array 20. The control circuitry 110 is coupled to the second end of each of the LED strings S1, S2, and S3 by the cabling 28. Based on any number of fixed or dynamic parameters, the control circuitry 110 may individually control the pulse width modulated current that flows through the respective LED strings S1, S2, and S3 such that the resultant white light emitted from the LED strings S1, S2, and S3 has a desired color temperature and falls within a desired proximity of the BBL. Certain of the many variables that may impact the current provided to each of the LED strings S1, S2, and S3 include: the magnitude of the AC power signal, the resultant white light, ambient temperature of the driver module 30 or LED array 20. Notably, the architecture used to drive the LED array 20 in this embodiment is merely exemplary, as those skilled in the art will recognize other architectures for controlling the drive voltages and currents presented to the LED strings S1, S2, and S3.

In certain instances, a dimming device controls the AC power signal. The rectifier and PFC circuitry 106 may be configured to detect the relative amount of dimming associated with the AC power signal and provide a corresponding dimming signal to the control circuitry 110. Based on the dimming signal, the control circuitry 110 will adjust the current provided to each of the LED strings S1, S2, and S3 to effectively reduce the intensity of the resultant white light emitted from the LED strings S1, S2, and S3 while maintaining the desired color temperature. Dimming instructions may alternatively be delivered from the communications module 32 to the control circuitry 110 in the form of a command via the communication bus.

The intensity or color of the light emitted from the LEDs 82 may be affected by ambient temperature. If associated with a thermistor $S_T$ or other temperature-sensing device, the control circuitry 110 can control the current provided to each of the LED strings S1, S2, and S3 based on ambient temperature in an effort to compensate for adverse temperature effects. The intensity or color of the light emitted from the LEDs 82 may also change over time. If associated with an LED light sensor $S_L$, the control circuitry 110 can measure the color of the resultant white light being generated by the LED strings S1, S2, and S3 and adjust the current provided to each of the LED strings S1, S2, and S3 to ensure that the resultant white light maintains a desired color temperature or other desired metric. The control circuitry 110 may also monitor the output of the occupancy and ambient light sensors $S_O$ and $S_A$ for occupancy and ambient light information.

The control circuitry 110 may include a central processing unit (CPU) and sufficient memory 112 to enable the control circuitry 110 to bidirectionally communicate with the communications module 32 or other devices over the communication bus through an appropriate communication interface (I/F) 114 using a defined protocol, such as the standard protocol described above. The control circuitry 110 may receive instructions from the communications module 32 or other device and take appropriate action to implement the received instructions. The instructions may range from controlling how the LEDs 82 of the LED array 20 are driven to returning operational data, such as temperature, occupancy, light output, or ambient light information, that was collected by the control circuitry 110 to the communications module 32 or other device via the communication bus. As described further below in association with FIG. 16, the functionality of the communications module 32 may be integrated into the driver module 30, and vice versa.

Figure 16:
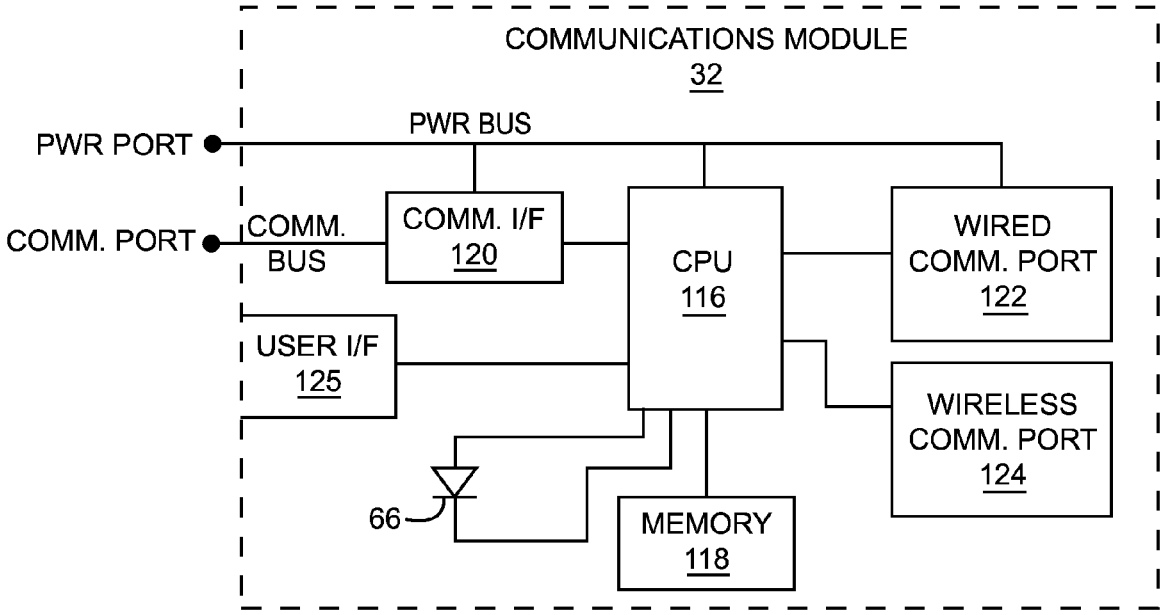
FIG. 16 is a block diagram of a communications module according to one embodiment of the disclosure.

With reference to FIG. 16, a block diagram of one embodiment of the communications module 32 is illustrated. The communications module 32 includes a CPU 116 and associated memory 118 that contains the requisite software instructions and data to facilitate operation as described herein. The CPU 116 may be associated with a communication interface 120, which is to be coupled to the driver module 30, directly or indirectly via the communication bus. The CPU 116 may be associated with a wired communication port 122, a wireless communication port 124, or both, to facilitate wired or wireless communications with other lighting fixtures 10 and remote control entities. The wireless communication port 124 may include the requisite transceiver electronics to facilitate wireless communications with remote entities. The wired communication port 122 may support universal serial (USB), Ethernet, or like interfaces.

The capabilities of the communications module 32 may vary greatly from one embodiment to another. For example, the communications module 32 may act as a simple bridge between the driver module 30 and the other lighting fixtures 10 or remote control entities. In such an embodiment, the CPU 116 will primarily pass data and instructions received from the other lighting fixtures 10 or remote control entities to the driver module 30, and vice versa. The CPU 116 may translate the instructions as necessary based on the protocols being used to facilitate communications between the driver module 30 and the communications module 32 as well as between the communications module 32 and the remote control entities. In other embodiments, the CPU 116 plays an important role in coordinating intelligence and sharing data among the lighting fixtures 10 as well as providing significant, if not complete, control of the driver module 30. While the communications module 32 may be able to control the driver module 30 by itself, the CPU 116 may also be configured to receive data and instructions from the other lighting fixtures 10 or remote control entities and use this information to control the driver module 30. The communications module 32 may also provide instructions to other lighting fixtures 10 and remote control entities based on the sensor data from the associated driver module 30 as well as the sensor data and instructions received from the other lighting fixtures 10 and remote control entities.

Power for the CPU 116, memory 118, the communication interface 120, and the wired and/or wireless communication ports 122 and 124 may be provided over the power bus via the power port. As noted above, the power bus may receive its power from the driver module 30, which generates the DC power signal. As such, the communications module 32 may not need to be connected to AC power or include rectifier and conversion circuitry. The power port and the communication port may be separate or may be integrated with the standard communication interface. The power port and communication port are shown separately for clarity. The communication bus may take many forms. In one embodiment, the communication bus is a 2-wire serial bus, wherein the connector or cabling configuration may be configured such that the communication bus and the power bus are provided using four wires: data, clock, power, and ground.

Those skilled in the art will recognize improvements and modifications to the embodiments of the present disclosure. All such improvements and modifications are considered within the scope of the concepts disclosed herein and the claims that follow.

What is claimed is:

1. A lighting fixture comprising:

a main structure;

a light source provided within the main structure and configured such that light emitted from the light source is directed out of the main structure toward an illuminated area; and a heatsink thermally coupled to the light source and having an exposed portion with a sensor recess, which is configured to receive a sensor module comprising at least one environmental sensor, which is exposed to the illuminated area, wherein the sensor recess comprises:

a main recess; and a plurality of partially open bosses on either side of the main recess where the main recess and the plurality of partially open bosses open to the end of the heatsink, such that opposing mounting tabs on the sensor module engage and slide into the plurality of partially open bosses as the sensor module is slid into the sensor recess via the end of the heatsink.

2. The lighting fixture of claim 1 wherein the heatsink comprises a plurality of fins on the exposed portion and extending generally toward the illuminated area.

3. The lighting fixture of claim 1 wherein the sensor recess is provided at an end of the heatsink.

4. The lighting fixture of claim 3 wherein the heatsink is elongated and comprises a plurality of fins on the exposed portion, extending generally toward the illuminated area, and running along a length of the heatsink up to the sensor recess.

5. The lighting fixture of claim 1 wherein at least a portion of the plurality of partially open bosses is threaded to receive screws.

6. The lighting fixture of claim 5 wherein the main structure comprises an end cap that has a plurality of holes that aligns with ends of the plurality of partially open bosses and a section that prevents the sensor module from sliding axially out of the sensor recess.

7. The lighting fixture of claim 1 wherein each of the plurality of partially open bosses is defined by a hole that extends axially into the end of the heatsink and an elongated slot that extends along at least a portion of the hole and connects the hole to the main recess.

8. The lighting fixture of claim 7 wherein each elongated slot has a width that is less than a diameter of the hole.

9. The lighting fixture of claim 1 further comprising the sensor module.

10. The lighting fixture of claim 9 wherein the heatsink has a main body in which the sensor recess is formed and the sensor module has a housing that substantially continues contours of the main body to provide an integrated aesthetic when the sensor module resides in the sensor recess.

11. The lighting fixture of claim 9 wherein the at least one environmental sensor comprises at least one of an occupancy sensor, an ambient light sensor, and a temperature sensor.

12. The lighting fixture of claim 9 wherein the at least one environmental sensor comprises at least two different types of environmental sensors.

13. The lighting fixture of claim 12 wherein the at least two different types of environmental sensors are configured to sense one environmental condition.

14. The lighting fixture of claim 12 wherein the at least two different types of environmental sensors are configured to sense different environmental conditions.

15. The lighting fixture of claim 9 wherein the sensor module comprises a housing with an ambient light sensor mounted inside of the housing.

16. The lighting fixture of claim 15 wherein the housing has a first opening that forms a light pipe receptacle such that when a light pipe is placed in the light pipe receptacle, ambient light is directed through the first opening to the ambient light sensor via the light pipe.

17. The lighting fixture of claim 16 wherein the light pipe receptacle has a first snap-fit feature that is configured to mate with a complementary second snap-fit feature of the light pipe, such that the light pipe releasably engages the light pipe receptacle via the first and second snap-fit features.

18. The lighting fixture of claim 16 wherein the sensor module further comprises an occupancy sensor that extends through a sensor opening in the housing.

19. The lighting fixture of claim 16 wherein the sensor module further comprises an occupancy sensor that extends through a sensor opening in the housing.

20. The lighting fixture of claim 9 wherein the sensor module further comprises a housing and an occupancy sensor that extends through a sensor opening in the housing.

21. A sensor module for a lighting fixture comprising:

a housing;

an ambient light sensor mounted within the housing below a first opening; and a light pipe, wherein the first opening comprises a snap-fit connector and the light pipe comprises a complementary snap-fit connector, which is configured to releasably engage the snap-fit connector.

22. The sensor module of claim 21 further comprising a connection mechanism configured to engage a heatsink on the lighting fixture.

23. The sensor module of claim 21 further comprising an occupancy sensor that extends through the housing via a second opening.

24. The sensor module of claim 21 further comprising a printed circuit board onto which at least one environmental sensor is mounted and where the housing comprises an upper housing and a lower housing that connect together to house the printed circuit board.

25. The sensor module of claim 24 wherein the at least one environmental sensor mounts to the printed circuit board and extends through the upper housing via a first opening.

26. The sensor module of claim 25 wherein the at least one environmental sensor is an occupancy sensor.

27. The sensor module of claim 24 wherein the at least one environmental sensor mounts to the printed circuit board and resides on the printed circuit board below a first opening in the upper housing.

28. The sensor module of claim 21 wherein the housing further comprises opposing tabs that extend outward from the housing and are configured to engage slots in the heatsink.

29. The sensor module of claim 28 wherein the heatsink has a sensor recess configured to receive the housing of the sensor module, and the slots in the heatsink are connected to the sensor recess.

30. The sensor module of claim 28 wherein the at least one environmental sensor comprises an ambient light sensor and an occupancy sensor.

31. The sensor module of claim 30 wherein the occupancy sensor extends through the housing via a second opening.

* * * * *